US008328693B2

(12) United States Patent
Sato

(10) Patent No.: US 8,328,693 B2
(45) Date of Patent: Dec. 11, 2012

(54) COMPRESSION TRAINING APPARATUS, COMPRESSION TRAINING SYSTEM AND METHOD OF CONTROL

(75) Inventor: Yoshiaki Sato, Fuchu (JP)

(73) Assignee: Sato Sports Plaza Co., Ltd., Tokyo (JP)

( * ) Notice: Subject to any disclaimer, the term of this patent is extended or adjusted under 35 U.S.C. 154(b) by 3 days.

(21) Appl. No.: 12/522,437

(22) PCT Filed: Dec. 26, 2007

(86) PCT No.: PCT/JP2007/075387
§ 371 (c)(1),
(2), (4) Date: Feb. 24, 2010

(87) PCT Pub. No.: WO2008/084752
PCT Pub. Date: Jul. 17, 2008

(65) Prior Publication Data

US 2010/0279820 A1 Nov. 4, 2010

(30) Foreign Application Priority Data

Jan. 9, 2007 (JP) ..... 2007-001011

(51) Int. Cl.
*A63B 71/00* (2006.01)

(52) U.S. Cl. ..... 482/4; 482/1; 482/8; 482/9; 482/901

(58) Field of Classification Search ..... 482/1–9, 482/900–902; 601/148–152; 606/201, 202
See application file for complete search history.

(56) References Cited

U.S. PATENT DOCUMENTS 3,675,640 A * 7/1972 Gatts ..... 600/484
4,617,937 A * 10/1986 Peel et al. ..... 600/493
4,889,132 A * 12/1989 Hutcheson et al. ..... 600/493
4,938,227 A * 7/1990 Niwa et al. ..... 600/495
5,050,613 A * 9/1991 Newman et al. ..... 600/483
5,738,612 A * 4/1998 Tsuda ..... 482/8
5,791,348 A * 8/1998 Aung et al. ..... 600/493
6,007,559 A * 12/1999 Arkans ..... 606/201
6,149,618 A * 11/2000 Sato ..... 602/75
6,283,922 B1 * 9/2001 Goto et al. ..... 600/485

(Continued)

FOREIGN PATENT DOCUMENTS

CN 1832785 A 9/2006

(Continued)

*Primary Examiner* — Glenn Richman
(74) *Attorney, Agent, or Firm* — Edell, Shapiro & Finnan, LLC

(57) ABSTRACT

To increase effects of KAATSU training and improve safety thereof.

A training system includes a tight fitting device 100 having an inflatable tube which is intended to be wrapped around a compression target range of an arm or a leg, a pressure regulating segment 200 that controls an applied pressure applied by the tight fitting device 100 to the compression target range by means of supplying air into the inflatable tube of the tight fitting device 100 or removing the air from the inflatable tube, a measuring segment 300, and a control segment 400. The measuring segment 300 measures a measurement target value which is one of a heart beat rate, a pulse wave value, and an oxygen saturation value, of a user who is receiving KAATSU training. When the measurement target value measured by the measuring segment 300 indicates that the KAATSU training should not be continued, then the control segment 400 notifies it to the pressure regulating segment 200 and terminates the KAATSU training.

14 Claims, 7 Drawing Sheets

U.S. PATENT DOCUMENTS

| | | | | |
|---|---|---|---|---|
| 7,354,380 | B2 * | 4/2008 | Volpe, Jr. | 482/4 |
| 7,413,527 | B2 * | 8/2008 | Sato | 482/1 |
| 7,455,630 | B2 * | 11/2008 | Sato | 482/111 |
| 2003/0212316 | A1 * | 11/2003 | Leiden et al. | 600/323 |
| 2005/0171443 | A1 * | 8/2005 | Gorenberg et al. | 600/490 |
| 2006/0128538 | A1 * | 6/2006 | Sato et al. | 482/112 |
| 2006/0201522 | A1 * | 9/2006 | Sato | 128/898 |
| 2006/0229661 | A1 * | 10/2006 | Sato | 606/201 |
| 2006/0270530 | A1 * | 11/2006 | Sato | 482/92 |
| 2007/0005106 | A1 * | 1/2007 | Adducci | 606/202 |
| 2007/0287613 | A1 * | 12/2007 | Adducci | 482/111 |
| 2008/0234788 | A1 * | 9/2008 | Wasowski | 607/104 |
| 2008/0294058 | A1 * | 11/2008 | Shklarski | 600/502 |
| 2009/0221406 | A1 * | 9/2009 | Sato | 482/113 |
| 2011/0060231 | A1 * | 3/2011 | Sato | 600/500 |

FOREIGN PATENT DOCUMENTS

| | | |
|---|---|---|
| JP | 07-144027 | 6/1995 |
| JP | 11-128397 | 5/1999 |
| JP | 2004-113622 | 4/2004 |
| JP | 2005-006921 | 1/2005 |
| JP | 2005-058544 | 3/2005 |

* cited by examiner

COMPRESSION TRAINING APPARATUS, COMPRESSION TRAINING SYSTEM AND METHOD OF CONTROL

TECHNICAL FIELD

The present invention relates to a training apparatus for the muscle development. More particularly, the present invention relates to a training apparatus suitable for KAATSU training that allows healthy people having no motor abnormalities as well as people having motor abnormalities to increase their muscle strength in an effective manner.

BACKGROUND ART

Mr. Yoshiaki Sato, the present inventor, has conducted studies for quite some time in order to develop a muscle strength increasing method for easy, safe, and effective muscle development, and put together the accomplishments into a patent application having Japanese Patent Application No. 5-313949, which has been granted as Japanese Patent No. 2670421.

The muscle strength increasing method according to the subject patent, which involves the application of pressure, is a distinctive non-conventional one. This muscle strength increasing method (hereinafter, referred to as "KAATSU training™ method") is based on the following theoretical concept.

Muscles are composed of slow-twitch muscle fibers and fast-twitch muscle fibers. Slow-twitch muscle fibers are limited in their potential for growth. Accordingly, it is necessary to recruit fast-twitch muscle fibers of the slow- and fast-twitch muscle fibers in order to develop muscles. Recruitment of fast-twitch muscle fibers causes lactic acid buildup in the muscles, which triggers secret ion of growth hormone from the pituitary. The growth hormone has effects of, for example, promoting muscle growth and shedding body fat. This means that recruitment and exhaustion of fast-twitch muscle fibers results in development of fast-twitch muscle fibers and, in turn, the entire muscles.

Slow-twitch muscle fibers and fast-twitch muscle fibers are different from each other in terms of the following. Slow-twitch muscle fibers use oxygen for energy and are recruited for low-intensity activities. Fast-twitch muscle fibers provide for activities regardless of whether or not oxygen is present. They are recruited after the slow-twitch muscle fibers for highly intense activities. Therefore, it is necessary to cause the earlier recruited and activated slow-twitch muscle fibers to be exhausted soon in order to recruit fast-twitch muscle fibers.

Conventional muscle strength increasing methods use heavy exercises with, for example, a barbell to cause the slow-twitch muscle fibers to be exhausted first, and then to recruit the fast-twitch muscle fibers. This recruitment of fast-twitch muscle fibers requires a significant amount of exercises, is time-consuming, and tends to increase the burden on muscles and joints.

On the other hand, one can perform exercises while pressure is applied circumferentially upon the muscles of a limb at a predetermined location near the top of the limb to restrict blood flow into the limb distal to the predetermined range. Since less oxygen is supplied to these muscles, the slow-twitch muscle fibers, which require oxygen for energy, are thus exhausted in a short period of time. Muscle exercises with blood-flow restriction by application of pressure will result in recruitment of the fast-twitch muscle fibers without needing a large amount of exercises. More specifically, when pressure is applied circumferentially upon a limb at a predetermined location near the top of the limb, venous circulation is restricted while arterial circulation is almost the same as the normal condition if an appropriate pressure is applied. This is because veins are closer to the skin surface of the limb, and are thinner and less muscular (less resistant against an applied force) than arteries while arteries are found deep within the limb, and are thicker and more muscular than veins. By holding that condition for a certain period of time, the limb that has compressed near the top thereof becomes engorged with blood which runs from arteries but cannot flow through veins. This condition is very close to the one achieved during heavy exercise of that limb. Consequently, the muscles get extremely exhausted. In addition, the muscle fatigue is also caused by the fact that the lactic acid that has built up in the muscles is less likely to be removed from the muscles because of the temporal occlusion of the veins.

A KAATSU training method can spuriously provide a condition as described above that is similar to conditions obtained during and after exercises . This means that the KAATSU training method provides effects of muscle training and promotes secretion of growth hormone.

Based on the aforementioned mechanism, restriction of muscle blood flow can provide significant development of the muscles.

The KAATSU training method is premised on the theoretical concept of muscle strength increase by the restriction of blood flow. More specifically, the KAATSU training method is intended to apply an appropriate applied pressure upon at least one of the limbs at a predetermined location near the top thereof, for the blood flow restriction into the limb distal to that location; put an appropriate stress attributed to blood flow decrease on the muscles, by the applied pressure; and thereby cause muscle fatigue. Thus, effective muscle development is achieved.

The KAATSU training method features muscle development without any exercises because it involves developing muscles by putting a stress attributed to blood flow decrease on the muscles. With this feature, the KAATSU training method is highly ef fective for the recovery of motor ability in people with impaired motor function, e.g., the elders or an injured person.

In addition, the KAATSU training method can compensate for a total amount of stress that is placed on the muscles by putting on the muscles a stress attributed to blood flow decrease. When combined with some exercises, the method advantageously reduces an exercise-related load as compared with conventional methods. This feature produces effects of reducing possible risks of joint- or muscle-damages and shortening a necessary time period for training, because it can decrease the amount of muscle exercises for the muscle development.

It should be noted that, for the implementation of the KAATSU training method, such a tool or device is essential that can restrict the blood flow through the muscles intended to be developed and that can precisely adjust the degree of blood flow restriction.

The present inventor has made studies for the KAATSU training method and, in the course of these studies, devised an invention relating to a training apparatus for KAATSU training as disclosed in Japanese Patent Application No. 2003-294014. The subject invention relates to a training system for KAATSU training comprising a tight fitting device having a hollow band and a rubber-made inflatable tube provided therein, and a training apparatus for KAATSU training that automatically adjusts the pressure of the air that is forced to the inflatable tube. The subject invention allows easy and proper compression of the limb by means of automatically controlling the air pressure, which contributes to providing easy and safe KAATSU training.

However, such a training system for KAATSU training still has a point that should be improved.

During the KAATSU training provided by using a training system for KAATSU training, a person who is receiving the KAATSU training may have some problems with his or her physical condition to such a degree that the KAATSU training should not be continued. In such cases, it becomes necessary to take certain safetymeasures (e.g., terminate the KAATSU training automatically or as immediately as possible) . However, there is no training system for KAATSU training that can cope with it.

It is therefore an object of the present invention to provide a technique with which a training system for KAATSU training of the type that applies an applied pressure by using a gas to at least one of the limbs near the top thereof can take safety measures if a person who is receiving KAATSU training has a problem with his or her physical condition to such a degree that the KAATSU training should not be continued.

SUMMARY OF THE INVENTION

In order to solve the aforementioned problems, the present inventor proposes the following invention. The present invention is embodied as a training apparatus for KAATSU training, a control method, and a training system for KAATSU training.

A training apparatus of the present application is used in combination with a tight fitting device comprising a band having the length that is enough to be wrapped around a predetermined range of one of the limbs of a user who receives KAATSU training; an inflatable tube provided in or on said band, said inflatable tube being of air-tight construction; and fastening means for fastening said band on said predetermined range with said band being wrapped around said predetermined range of one of the limbs, said fastening means being provided on said band, said tight fitting device being adapted to apply a predetermined applied pressure to said predetermined range of said limb by means of filling said inflatable tube with a gas, the predetermined applied pressure being for restricting the blood flow into the limb distal to said predetermined range; and measuring means for measuring at least one of a physical quantity that varies in conjunction with a heart beat, a physical quantity that varies in conjunction with a pulse wave , and a physical quantity that varies in conjunction with oxygen saturation, in said limb on which said tight fitting device is placed, to generate at least one of heart beat data associated with a heartbeat rate that represents the number of times your heart contracts, pulse wave data associated with a pulse wave value that represents the amplitude of pulse waves, and oxygen saturation data associated with an oxygen saturation value that represents the degree of oxygen saturation; and is adapted to control said applied pressure.

This training apparatus comprises pressure regulating means that is capable of forcing a gas into said inflatable tube and removing the gas from said inflatable tube, via a predetermined tube; and control means for controlling said pressure regulating means in order to change said applied pressure.

In addition, said control means of this training apparatus is adapted to receive at least one of said heart beat data, said pulse wave data, and said oxygen saturation data, from said measuring means, and adapted to control said pressure regulating means in such a manner that said pressure regulating means removes the gas from said inflatable tube to the degree that can ensure the safety of the user, when at least one of said heart beat data, said pulse wave data, and said oxygen saturation data that has been received indicates that said user should not continue the KAATSU training.

According to the studies made by the present inventor, it has been found that at least one of the circumstances under which the KAATSU training should not be continued occurs as follows. As described above, during the KAATSU training, it is necessary that the veins are temporarily occluded and that arteries are almost the same as the normal condition. However, if arteries as well as veins are occluded for some reason or if arteries are excessively occluded, blood flow to the arm or the leg is prevented, that is, a phenomenon which is so-called cessation of blood flow occurs. Under such circumstances, the KAATSU training should not be continued any more. According to the studies made by the present inventor, such occlusion of arteries leads to changes in at least one of the number of times the heart of a KAATSU training user contracts (heart beat rate), the amplitude of pulse waves (pulse wave value), and the degree of oxygen saturation (oxygen saturation value).

The present invention indirectly monitors arterial blood circulation of the user who is receiving the KAATSU training, by using the heart beat data, the pulse wave data, and the oxygen saturation data, which are associated therewith. In addition, if at least one of these data indicates that the KAATSU training should not be continued, that is, if at least one of these data indicates that arteries of the user who is receiving the KAATSU training are occluded too much, the control means of the training apparatus controls the pressure regulating means in such a manner that the pressure regulating means removes the gas from the inflatable tube.

As a result, according to the present invention, if the user who is receiving the KAATSU training has a problem with his or her physical condition to such a degree that the KAATSU training should not be continued, safety measures can be taken automatically. This has a significant meaning in improving the safety of the KAATSU training. The KAATSU training can be applied to various fields including medical, rehabilitation and nursing care fields. In such cases, it is often difficult for the user who receives the KAATSU training to operate the training apparatus. Taking this into account, it is preferable to have an automatic safety measure as in the case of the training apparatus of the present invention.

The measuring means in the present invention may be adapted to generate two or more of the heart beat data, the pulse wave data, and the oxygen saturation data. In such cases, the control means in the present invention is adapted to receive two or more of the heart beat data, the pulse wave data, and the oxygen saturation data. The pressure regulating means may be controlled in such a manner that the pressure regulating means removes the gas from the inflatable tube when at least one or all of these data indicate(s) that the user should not continue the KAATSU training.

In the present invention, the tight fitting device may be a single one, or two or more tight fitting devices may be provided. When there are two or more tight fitting devices, then the number of the pressure regulating means can be the same as the number of the tight fitting devices. The control means controls each of the pressure regulating means in the same manner or in different manners. When the number of the pressure regulating means is equal to the number of the tight fitting devices, single control means may control all pressure regulating means. Alternatively, the control means of the number equal to that of the tight fitting devices may control their respective pressure regulating means associated with the respective tight fitting devices.

The aforementioned effects can be obtained by using the following control method and training system.

The control method is carried out by control means of a training apparatus, the training apparatus being used in combination with a tight fitting device comprising a band having the length that is enough to be wrapped around a predetermined range of one of the limbs of a user who receives KAATSU training; an inflatable tube provided in or on said band, said inflatable tube being of air-tight construction; and fastening means for fastening said band on said predetermined range with said band being wrapped around said predetermined range of one of the limbs, said fastening means being provided on said band, said tight fitting device being adapted to apply a predetermined applied pressure to said predetermined range of said limb by means of filling said inflatable tube with a gas, the predetermined applied pressure being for restricting the blood flow into the limb distal to said predetermined range; and a measuring segment for measuring at least one of a physical quantity that varies in conjunction with a heart beat, a physical quantity that varies in conjunction with a pulse wave , and a physical quantity that varies in conjunction with oxygen saturation, in said limb on which said tight fitting device is placed, to generate at least one of heart beat data associated with a heart beat rate that represents the number of times your heart contracts, pulse wave data associated with a pulse wave value that represents the amplitude of pulse waves, and oxygen saturation data associated with an oxygen saturation value that represents the degree of oxygen saturation; the training apparatus comprising pressure regulating means that is capable of forcing a gas into said inflatable tube and removing the gas from said inflatable tube, via a predetermined tube; and said control means for controlling said pressure regulating means in order to change said applied pressure.

In this control method, said control means comprises the steps of receiving at least one of said heart beat data, said pulse wave data, and said oxygen saturation data, from said measuring segment; and controlling said pressure regulating means in such a manner that said pressure regulating means removes the gas from said inflatable tube to the degree that can ensure the safety of the user, when at least one of said heart beat data, said pulse wave data, and said oxygen saturation data that has been received indicates that said user should not continue the KAATSU training.

A training system of this application comprises a tight fitting device comprising a band having the length that is enough to be wrapped around a predetermined range of one of the limbs of auserwho receives KAATSU training; an inflatable tube provided in or on said band, said inflatable tube being of air-tight construction; and fastening means for fastening said band on said predetermined range with said band being wrapped around said predetermined range of one of the limbs, said fastening means being provided on said band, said tight fitting device being adapted to apply a predetermined applied pressure to said predetermined range of said limb by means of filling said inflatable tube with a gas, the predetermined applied pressure being for restricting the blood flow into the limb distal to said predetermined range; pressure regulating means that is capable of forcing a gas into said inflatable tube and removing the gas from said inflatable tube, via a predetermined tube; control means for controlling said pressure regulating means in order to change said applied pressure; and measuring means for measuring at least one of a physical quantity that varies in conjunction with a heart beat, a physical quantity that varies in conjunction with a pulse wave, and a physical quantity that varies in conjunction with oxygen saturation, in said limb on which said tight fitting device is placed, to generate at least one of heart beat data associated with a heart beat rate that represents the number of times your heart contracts, pulse wave data associated with a pulse wave value that represents the amplitude of pulse waves, and oxygen saturation data associated with an oxygen saturation value that represents the degree of oxygen saturation.

Said control means of this training system is adapted to receive at least one of said heart beat data, said pulse wave data, and said oxygen saturation data, from said measuring means, and adapted to control said pressure regulating means in such a manner that said pressure regulating means removes the gas from said inflatable tube to the degree that can ensure the safety of the user, when at least one of said heart beat data, said pulse wave data, and said oxygen saturation data that has been received indicates that said user should not continue the KAATSU training.

A requirement is that said control means in the present invention controls the pressure regulating means in such a manner that the pressure regulating means removes the gas from the inflatable tube when at least one of said heart beat data, said pulse wave data, and said oxygen saturation data that has been received indicates that said user should not continue the KAATSU training. In this case, how much the gas pressure in the inflatable tube is reduced by the pressure regulating means can be appropriately adjusted or determined according to how much the pressure should be reduced to ensure the safety of the user who is receiving the KAATSU training.

For example, said control means may be adapted to control said pressure regulating means in such a manner that said pressure regulating means reduces the gas pressure in said inflatable tube from the pressure at that point of time by 80% or more of the difference between the pressure at that point of time and the atmospheric pressure, when at least one of said heart beat data, said pulse wave data, and said oxygen saturation data that has been received indicates that said user should not continue the KAATSU training. This is because reduction of the gas pressure in the inflatable tube to this degree generally ensures the safety of the user who is receiving the KAATSU training.

Alternatively, said control means may be adapted to control said pressure regulating means in such a manner that said pressure regulating means reduces the gas pressure in said inflatable tube from the pressure at that point of time by 90% or more of the difference between the pressure at that point of time and the atmospheric pressure, when at least one of said heart beat data, said pulse wave data, and said oxygen saturation data that has been received indicates that said user should not continue the KAATSU training. In addition, said control means may be adapted to control the pressure regulating means in such a manner that said pressure regulating means reduces the gas pressure in said inflatable tube to a pressure generally identical to the atmospheric pressure, when at least one of said heart beat data, said pulse wave data, and said oxygen saturation data that has been received indicates that said user should not continue the KAATSU training. These approaches provide higher safety than the aforementioned approach does.

In addition, the control means may be adapted to direct the pressure regulating means to supply the gas again into the inflatable tube in order to allow the user to restart the KAATSU training, after the lapse of a predetermined period of time since the pressure regulating means removes the gas from the inflatable tube under the control of the control means. Alternatively, the control means may continuously receive at least one of the heart beat data, the pulse wave data, and the oxygen saturation data even after the pressure regulating means removes the gas from the inflatable tube under the control of the control means, and may direct the pressure regulating means to supply the gas again into the inflatable tube in order to allow the user to restart the KAATSU training when none of the heart beat data, pulse wave data, and the oxygen saturation data indicates that said user should not continue the KAATSU training.

For example, said control means may be adapted to control said pressure regulating means in such a manner that said pressure regulating means removes the gas from said inflatable tube to the degree that can ensure the safety of the user when at least one of said heart beat data, said pulse wave data, and said oxygen saturation data that has been received indicates that said user should not continue the KAATSU training, and adapted to control said pressure regulating means in such a manner that said pressure regulating means supplies the gas into said inflatable tube to thereby restart the KAATSU training after the lapse of a certain period of time.

Alternatively, said control means may be adapted to control said pressure regulating means in such a manner that said pressure regulating means removes the gas from said inflatable tube to the degree that can ensure the safety of the user when at least one of said heart beat data, said pulse wave data, and said oxygen saturation data that has been received indicates that said user should not continue the KAATSU training, and adapted to control said pressure regulating means in such a manner that said pressure regulating means supplies the gas into said inflatable tube to thereby restart the KAATSU training if said heart beat data, said pulse wave data, or said oxygen saturation data, which has indicated that the KAATSU training should not be continued, no longer indicates that the KAATSU training should not be continued.

According to the studies made by the present inventor, it has been found that the heart beat rate decreases if the arteries become excessively occluded during the KAATSU training. Based on this, excessive occlusion of the arteries can be detected in the present invention in a manner described below.

When said measuring means in the present invention is the one that generates the heart beat data associated with the heart beat rate by means of measuring the physical quantity that varies in conjunction with the heart beat, said control means can be adapted to control said pressure regulating means in such a manner that said pressure regulating means removes the gas from said inflatable tube to the degree that can ensure the safety of the user when said heart beat data that has been received from said measuring means indicates that said heart beat rate of the user falls below a reference heart beat rate that is a predetermined heart beat rate. The training apparatus in this case may comprise input means for use in providing data associated with said reference heart beat rate. In this case, said control means may be adapted to determine said reference heart beat rate according to the data provided by using said input means. The aforementioned data input by using the input means may be done by, for example, a person such as a doctor who has a wealth of knowledge about the KAATSU training. This can ensure higher safety of the KAATSU training. Alternatively, said control means may autonomously determine said reference heart beat rate. In this case, said control means maybe adapted to determine said reference heart beat rate so that it falls within the range of 85% to 95% of said heart beat rate of the user at rest. This range of the reference heart beat rate is determined based on the fact that it is often unsafe if heart beat rate decreases by about 10% as compared to the normal heart beat rate, and that there are differences among individuals. Said reference heart beat rate may be determined as a value that is approximately 90% of the normal heart beat rate of said user. It is noted that the term "normal" refers to a normal condition of the user when he or she is receiving the KAATSU training, rather than a normal conduction of the user during the daily living. For example, the normal condition may be the condition where not a long time has passed (e.g., within 120 seconds) since the inflatable tube is filled with the gas to achieve an appropriate pressure for the KAATSU training, or the condition where the user could previously perform the KAATSU training safely. The definition of the "normal" applies to other part of the present application.

In addition, when said measuring means in the present invention is the one that generates the heart beat data associated with the heart beat rate by means of measuring the physical quantity that varies in conjunction with the heart beat, said control means maybe adapted to control said pressure regulating means in such a manner that said pressure regulating means removes the gas from said inflatable tube to the degree that can ensure the safety of the user when said heart beat data that has been received from said measuring means indicates that the heart beat rate increases or decreases by 10% or more as compared to the heart beat rate at a certain point of time, within 60 seconds (e.g., within 30 seconds). This amount is determined by taking into account that the safety of the user is often threatened, such as in the case where the degree of temporal arterial occlusion exceeds the safety threshold, if the heart beat rate fluctuates to such a degree within such a period of time. In this case, increase of heart beat rate is taken into consideration because a possible risk for which the temporal arterial occlusion is not responsible can be detected only occasionally from the increase of heart beat rate. It is noted that the heart beat rate increases even under safe conditions when the user performs some exercises during the KAATSU training, so that in many cases a possible risk can be detected from the increase of heart beat rate only if the KAATSU training is performed while the user is at rest. The term "at rest" as used herein does not refer to complete rest in the proper sense of the word without moving arms and legs.

According to the studies made by the present inventor, it has been found that the pulse wave value is decreased if the arteries become excessively occluded during the KAATSU training. Based on this, excessive occlusion of the arteries can be detected in the present invention in a manner described below.

When said measuring means in the present invention is the one that generates the pulse wave data associated with the pulse wave value by means of measuring the physical quantity that varies in conjunction with the pulse wave, said control means can be adapted to control said pressure regulating means in such a manner that said pressure regulating means removes the gas from said inflatable tube to the degree that can ensure the safety of the user when said pulse wave data that has been received from said measuring means indicates that said pulse wave value of the user falls below a reference pulse wave value that represents a predetermined amplitude of pulse waves. In this case, the training apparatus may comprise input means for use in providing data associated with said reference pulse wave value. Said control means in this case may be adapted to determine said reference pulse wave value according to the data provided by using said input means. The aforementioned data input by using the input means may be done by, for example, a person such as a doctor who has a wealth of knowledge about the KAATSU training. This can ensure higher safety of the KAATSU training. Alternatively, said control means may autonomously determine said reference pulse wave value. In this case, said control means may be adapted to determine said reference pulse wave value so that it falls within the range of 85% to 95% of said pulse wave value of the user at rest. This range of the reference pulse wave value is determined based on the fact that it is often unsafe if pulse wave value is decreased by about 10% as compared to the normal pulse wave value, and that there are differences among individuals. Said reference pulse wave value may be determined as a value that is approximately 90% of the normal pulse wave value of said user.

In addition, when said measuring means in the present invention is the one that generates the pulse wave data associated with the pulse wave value by means of measuring the physical quantity that varies in conjunction with the pulse wave, said control means may be adapted to control said pressure regulating means in such a manner that said pressure regulating means removes the gas from said inflatable tube to the degree that can ensure the safety of the user when said pulse wave data that has been received from said measuring means indicates that the pulse wave value is increased or decreased by 10% or more as compared to the pulse wave value at a certain point of time, within 60 seconds (e.g., within 30 seconds). This amount is determined by taking into account that the safety of the user is often threatened, such as in the case where the degree of temporal arterial occlusion exceeds the safety threshold, if the pulse wave value fluctuates to such a degree within such a period of time. In this case, increase of pulse wave value is taken into consideration because a possible risk for which the temporal arterial occlusion is not responsible can be detected only occasionally from the increase of pulse wave value. It is noted that the pulse wave value is increased even under safe conditions when the user performs some exercises during the KAATSU training, so that a possible risk can be detected from the increase of pulse wave value only if the KAATSU training is performed while the user is at rest.

According to the studies made by the present inventor, it has been found that the oxygen saturation value is decreased if the arteries become excessively occluded during the KAATSU training. Based on this, excessive occlusion of the arteries can be detected in the present invention in a manner described below.

When said measuring means in the present invention is the one that generates the oxygen saturation data associated with the oxygen saturation value by means of measuring the physical quantity that varies in conjunction with the oxygen saturation, said control means can be adapted to control said pressure regulating means in such a manner that said pressure regulating means removes the gas from said inflatable tube to the degree that can ensure the safety of the user when said oxygen saturation data that has been received from said measuring means indicates that said oxygen saturation value of the user falls below a reference oxygen saturation value that represents a predetermined degree of oxygen saturation. The training apparatus in this case may comprise input means for use in providing data associated with said reference oxygen saturation value. In this case, said control means may be adapted to determine said reference oxygen saturation value according to the data provided by using said input means. The aforementioned data input by using the input means may be done by, for example, a person such as a doctor who has a wealth of knowledge about the KAATSU training. This can ensure higher safety of the KAATSU training. Alternatively, said control means may autonomously determine said reference oxygen saturation value. In this case, said control means may be adapted to determine said reference oxygen saturation value so that it falls within the range of 95% to 99% of said oxygen saturation value of the user at rest. This range of the reference oxygen saturation value is determined based on the fact that it is often unsafe if oxygen saturation value is decreased by about 3% as compared to the normal oxygen saturation value, and that there are differences among individuals. Said reference oxygen saturation value may be determined as a value that is approximately 97% of the normal oxygen saturation value of said user.

In addition, when said measuring means in the present invention is the one that generates the oxygen saturation data associated with the oxygen saturation value by means of measuring the physical quantity that varies in conjunction with the oxygen saturation, said control means may be adapted to control said pressure regulating means in such a manner that said pressure regulating means removes the gas from said inflatable tube to the degree that can ensure the safety of the user when said oxygen saturation data that has been received from said measuring means indicates that the magnitude of the oxygen saturation value is increased or decreased by 3% or more as compared to the oxygen saturation value at a certain point of time, within 60 seconds (e.g., within 30 seconds). This amount is determined by taking into account that the safety of the user is often threatened, such as in the case where the degree of temporal arterial occlusion exceeds the safety threshold, if the oxygen saturation value fluctuates to such a degree within such a period of time. In this case, increase of oxygen saturation value is taken into consideration because a possible risk for which the temporal arterial occlusion is not responsible can be detected only occasionally from the increase of oxygen saturation value. It is noted that the oxygen saturation value is increased even under safe conditions when the user performs some exercises during the KAATSU training, so that a possible risk can be detected from the increase of oxygen saturation value only if the KAATSU training is performed while the user is at rest.

Furthermore, the present invention proposes the following training apparatus.

This training apparatus is used in combination with a tight fitting device comprising a band having the length that is enough to be wrapped around a predetermined range of one of the limbs of a user who receives KAATSU training; an inflatable tube provided in or on said band, said inflatable tube being of air-tight construction; and fastening means for fastening said band on said predetermined range with said band being wrapped around said predetermined range of one of the limbs, said fastening means being provided on said band, said tight fitting device being adapted to apply a predetermined applied pressure to said predetermined range of said limb by means of filling said inflatable tube with a gas, the predetermined applied pressure being for restricting the blood flow into the limb distal to said predetermined range; and measuring means for measuring at least one of a physical quantity that varies in conjunction with a heart beat, a physical quantity that varies in conjunction with a pulse wave, and a physical quantity that varies in conjunction with oxygen saturation, in said limb on which said tight fitting device is placed, to generate at least one of heart beat data associated with a heart beat rate that represents the number of times your heart contracts, pulse wave data associated with a pulse wave value that represents the amplitude of pulse waves, and oxygen saturation data associated with an oxygen saturation value that represents the degree of oxygen saturation; and is adapted to control said applied pressure.

This training apparatus comprises pressure regulating means that is capable of forcing a gas into said inflatable tube and removing the gas from said inflatable tube, via a predetermined tube; control means for controlling said pressure regulating means in order to change said applied pressure; and notification means adapted to provide, when activated, a notification that can be perceived through human's five senses. In addition, said control means is adapted to receive at least one of said heart beat data, said pulse wave data, and said oxygen saturation data, from said measuring means, and adapted to activate said notification means, when at least one of said heart beat data, said pulse wave data, and said oxygen saturation data that has been received indicates that said user should not continue the KAATSU training.

Unlike those described above, in this training apparatus, the control means does not direct the pressure regulating means to remove the gas from the inflatable tube, even when at least one of the heart beat data, the pulse wave data, and the oxygen saturation data indicates that the user receiving the KAATSU training should not continue the KAATSU training. Instead, the control means in this invention activates the notification means under such circumstances and directs the notification means to produce a notification that can be perceived through human's five senses. Thus, this invention provides a trigger for the user receiving the KAATSU training or another person to take safety measures in case the user who is receiving the KAATSU training has some problems with his or her physical condition to such a degree that the KAATSU training should not be continued. The notification provided by the notification means may appropriately be selected from among, for example, visual approaches such as lighting of a lamp and acoustic approaches such as production of a sound through a speaker.

The following method can also provide effects that are similar to those obtained with the training apparatus having the notification means.

The method is the that is carried out by control means of a training apparatus, the training apparatus being used in combination with a tight fitting device comprising a band having the length that is enough to be wrapped around a predetermined range of one of the limbs of a user who receives KAATSU training; an inflatable tube provided in or on said band, said inflatable tube being of air-tight construction; and fastening means for fastening said band on said predetermined range with said band being wrapped around said predetermined range of one of the limbs, said fastening means being provided on said band, said tight fitting device being adapted to apply a predetermined applied pressure to said predetermined range of said limb by means of filling said inflatable tube with a gas, the predetermined applied pressure being for restricting the blood flow into the limb distal to said predetermined range; and a measuring segment for measuring at least one of a physical quantity that varies in conjunction with a heart beat, a physical quantity that varies in conjunction with a pulse wave , and a physical quantity that varies in conjunction with oxygen saturation, in said limb on which said tight fitting device is placed, to generate at least one of heart beat data associated with a heart beat rate that represents the number of times your heart contracts, pulse wave data associated with a pulse wave value that represents the amplitude of pulse waves, and oxygen saturation data associated with an oxygen saturat ion value that represents the degree of oxygen saturation; the training apparatus comprising pressure regulating means that is capable of forcing a gas into said inflatable tube and removing the gas from said inflatable tube, via a predetermined tube; said control means for controlling said pressure regulating means in order to change said applied pressure; and notification means adapted to provide, when activated, a notification that can be perceived through human's five senses.

In this method, said control means comprising the steps of receiving at least one of said heart beat data, said pulse wave data, and said oxygen saturation data, from said measuring segment; and activating said notification means, when at least one of said heart beat data, said pulse wave data, and said oxygen saturation data that has been received indicates that said user should not continue the KAATSU training.

The following training system can also provide effects that are similar to those obtained with the training apparatus having the notification means.

The training system comprises a tight fitting device comprising a band having the length that is enough to be wrapped around a predetermined range of one of the limbs of a user who receives KAATSU training; an inflatable tube provided in or on said band, said inflatable tube being of air-tight construction; and fastening means for fastening said band on said predetermined range with said band being wrapped around said predetermined range of one of the limbs, said fastening means being provided on said band, said tight fitting device being adapted to apply a predetermined applied pressure to said predetermined range of said limb by means of filling said inflatable tube with a gas, the predetermined applied pressure being for restricting the blood flow into the limb distal to said predetermined range; pressure regulating means that is capable of forcing a gas into said inflatable tube and removing the gas from said inflatable tube, via a predetermined tube; control means for controlling said pressure regulating means in order to change said applied pressure; measuring means for measuring at least one of a physical quantity that varies in conjunction with a heart beat, a physical quantity that varies in conjunction with a pulse wave, and a physical quantity that varies in conjunction with oxygen saturation, in said limb on which said tight fitting device is placed, to generate at least one of heart beat data associated with a heart beat rate that represents the number of times your heart contracts, pulse wave data associated with a pulse wave value that represents the amplitude of pulse waves, and oxygen saturation data associated with an oxygen saturation value that represents the degree of oxygen saturation; and notification means adapted to provide, when activated, a notification that can be perceived through human's five senses. The control means is adapted to receive at least one of said heart beat data, said pulse wave data, and said oxygen saturation data, from said measuring means, and adapted to activate said notification means, when at least one of said heart beat data, said pulse wave data, and said oxygen saturation data that has been received indicates that said user should not continue the KAATSU training.

The criteria described in conjunction with the aforementioned invention in which the gas is removed from the inflatable tube when it is indicated that the user should not continue the KAATSU training, can be applied as the criteria on which the training apparatus having the notification means as described above is activated, that is, the criteria to determine whether at least one of said heart beat data, said pulse wave data, and said oxygen saturation data that has been received by the control means indicates that said user should not continue the KAATSU training.

In addition, the training apparatus having the notification means may be combined with the invention in which the gas is removed from the inflatable tube when at least one of said heart beat data, said pulse wave data, and said oxygen saturation data that has been received by the control means indicates that said user should not continue the KAATSU training.

BEST MODES FOR CARRYING OUT THE INVENTION

Figure 1:
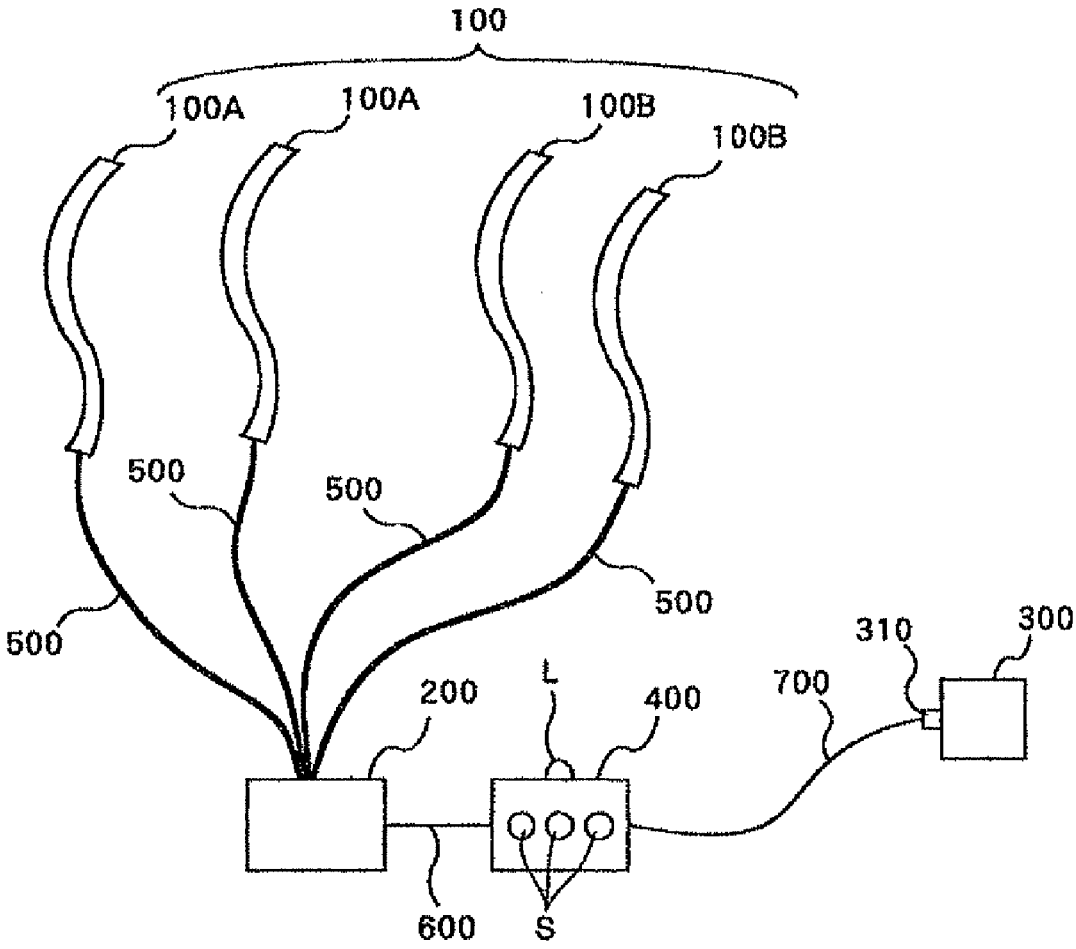
FIG. 1 is a view schematically showing the entire configuration of a KAATSU training system of an embodiment of the present invention.

A preferred embodiment of the present invention is described now with reference to the drawing.

FIG. 1 is a view schematically showing the entire configuration of a KAATSU training system according to an embodiment of the present invention.

As shown in FIG. 1, the KAATSU training system according to this embodiment comprises a tight fitting device 100, a pressure regulating segment 200, a measuring segment 300, and a control segment 400. The combination of the pressure regulating segment 200 and the control segment 400 corresponds to the KAATSU training apparatus in the present invention. In this embodiment, although the pressure regulating segment 200 is provided as a separate component from the control segment 400, they may be integrated to each other as a single component.

Figure 2:
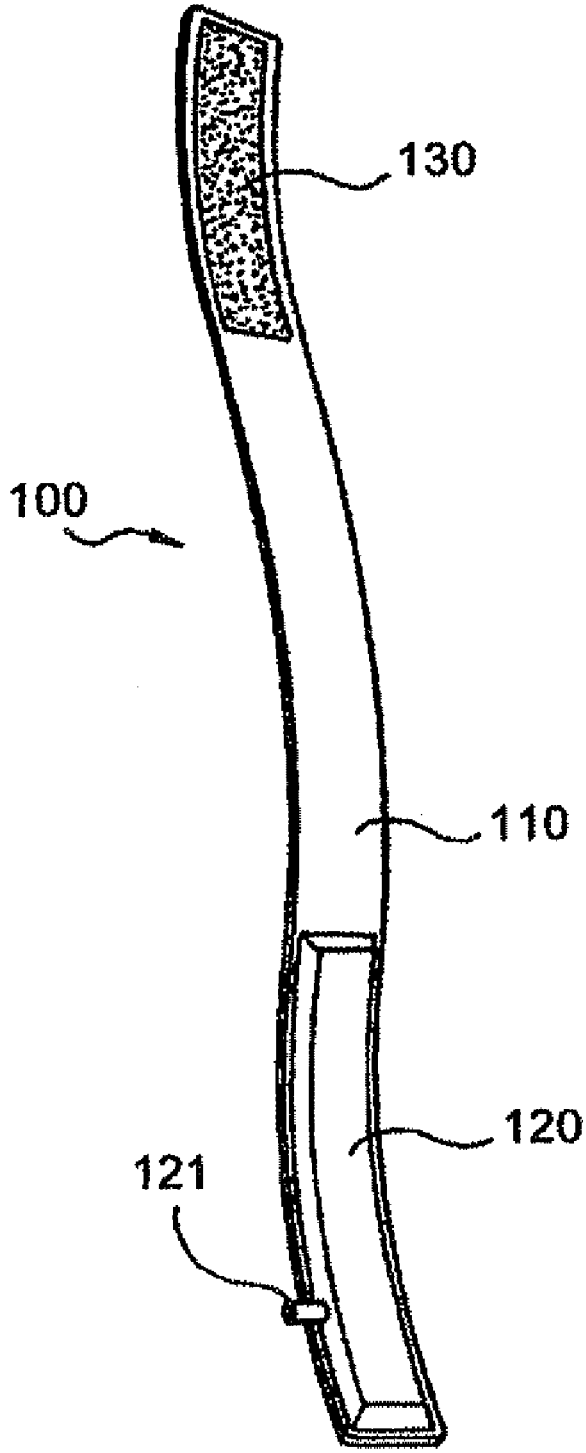
FIG. 2 is a perspective view showing a tight fitting device included in the KAATSU training system in FIG. 1.
Figure 3:
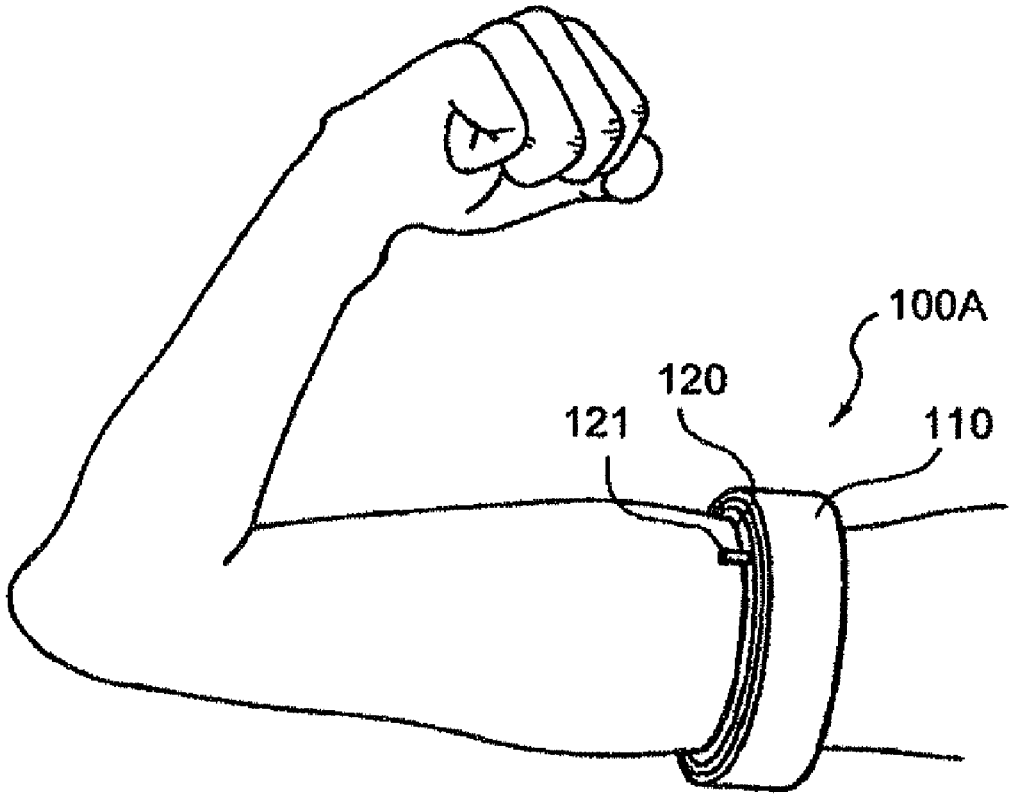
FIG. 3 is a view illustrating how a tight fitting device for arms included in the KAATSU training system in FIG. 1 is used.
Figure 4:
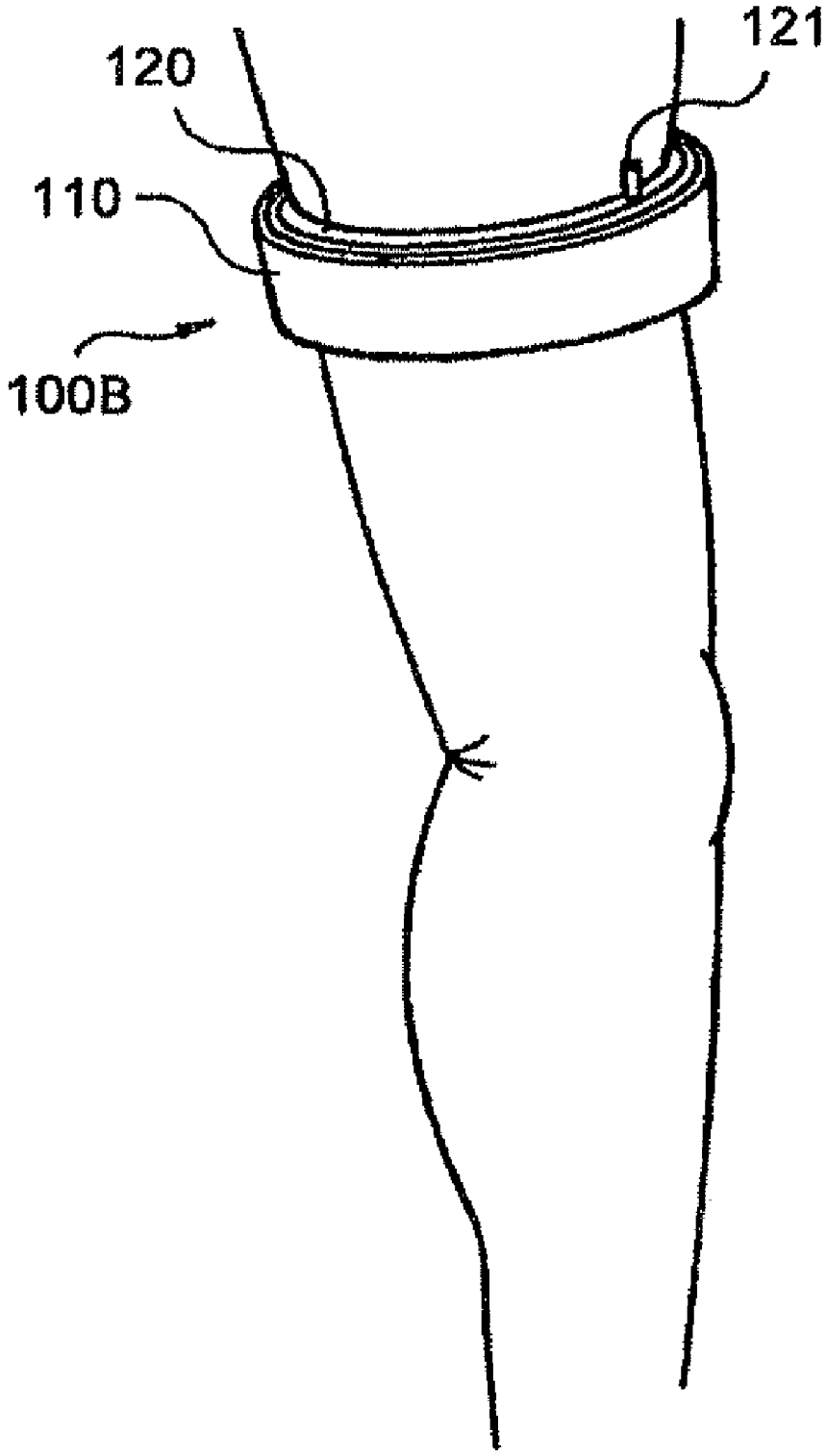
FIG. 4 is a view illustrating how a tight fitting device for legs included in the KAATSU training system in FIG. 1 is used.

The tight fitting device 100 in this embodiment is configured as shown in FIGS. 2, 3, and 4. FIG. 2 is a perspective view showing an embodiment of the tight fitting device 100. FIGS. 3 and 4 are perspective views illustrating how the tight fitting device 100 is used.

The tight fitting device 100 in this embodiment comprises a plurality of, more specifically, four members as shown in FIG. 1. The reason why there are four tight fitting devices 100 is to allow compression of the arms and legs of a person who receives KAATSU training. As to compression by the tight fitting device 100, two or more tight fitting devices 100 out of four can be activated at the same time, or alternatively, four tight fitting devices 100 can be activated in sequence so that none of them are activated simultaneously.

Of the tight fitting devices 100 in this embodiment, tight fitting devices 100A are for arms (each of which is intended to be wrapped around an arm for the compression of the arm) while tight fitting devices 100B are for legs (each of which is intended to be wrapped around a leg for the compression of the leg). The number of the tight fitting devices 100 is not necessarily four. Any number equal to or larger than one may be used. The number of the tight fitting device(s) 100A for arms is not necessarily identical with the number of the tight fitting device(s) 100B for legs.

The tight fitting device 100 in this embodiment is intended to be wrapped around a given range of muscles of one of the limbs (the given range is generally located at a position near the top of the arm or near the top of the leg that is suitable for the restriction of the blood flow by the external compression; hereinafter, which may also be referred to as a "compression target range"), is intended to apply an applied pressure to the given range of muscles by means of compressing the given range of muscles, and is adapted so that the applied pressure can be varied. This tight fitting device 100 basically comprises a band 110, an inflatable tube 120, and a fastening member 130, in this embodiment.

Details of the band 110 do not matter as long as it can be wrapped around a given range around which the tight fitting device 100 is to be wrapped.

The band 110 in this embodiment may be made of a material having a certain degree of stretchability, but not limited thereto. More specifically, it is made of a neoprene rubber.

The length of the band 110 according to this embodiment is determined in accordance with the girth of the compression target range compressed by the tight fitting device 100 of a person who receives the KAATSU training. The length of the band 110 may be any length that is longer than the girth of the compression target range. The length of the band 110 in this embodiment is twice or longer than the girth of the compression target range. The length of the band 110 of the tight fitting device 100A for arms according to this embodiment is determined in view of the girth of the compression target range on the arm being 26 cm. More specifically it is 90 cm. The length of the band 110 of the tight fitting device 100B for legs is determined in view of the girth of the compression target range on the leg being 45 cm. More specifically, it is 145 cm.

The width of the band 110 according to this embodiment may suitably be determined for the respective ranges to be compressed by the tight fitting device 100. For example, in this embodiment, the band 110 of the tight fitting device 100A for arms is about 3 cm in width while the band 110 of the tight fitting device 100B for legs is about 5 cm in width.

The inflatable tube 120 is attached to the band 110. The inflatable tube 120 in this embodiment is attached to one surface of the band 110. However, the way to attach the inflatable tube 120 to the band 110 is not limited thereto. The inflatable tube 120 may be provided within a bag-shaped band 110.

One end of the inflatable tube 120 is aligned with the corresponding end of the band 110 (the lower end of the band 110 in FIG. 2) but not limited thereto. The inflatable tube 120 is an air-tight bag that is formed of an air-tight material. The inflatable tube 120 in this embodiment is made of a stretchable rubber similar to that of, for example, an inflatable bladder used in a blood pressure cuff (a sleeve of a blood pressure gauge that is wrapped around the arm). The material of the inflatable tube 120 is not limited thereto. Any material that can maintain air tightness may appropriately be used.

The length of the inflatable tube 120 is, but not limited to, generally equal to the girth of the compression target range in this embodiment. The inflatable tube 120 of the tight fitting device 100A for arms is 25 cm in length while the inflatable tube 120 of the tight fitting device 100B for legs is 45 cm in length, in this embodiment.

In addition, the width of the inflatable tube 120 may suitably be determined for the respective ranges to be compressed by the tight fitting device 100. In this embodiment, the inflatable tube 120 of the tight fitting device 100A for arms is about 3 cm in width while the inflatable tube 120 of the tight fitting device 100B for legs is about 5 cm in width, both of which are not the requirements.

The inflatable tube 120 has a connection inlet 121 that is communicated with the inside of the inflatable tube 120. It maybe connected with the pressure regulating segment 200 through, for example, a connecting pipe 500 comprised of a rubber tube. As will be described below, through the connection inlet 121, a gas (air in this embodiment) is introduced into the inflatable tube 120 or the gas in the inflatable tube 120 escapes therefrom to the outside.

The fastening member 130 is for fastening the band 110 so that it is held with being wrapped around the compression target range. The fastening member 130 in this embodiment is a two-dimensional fastener provided at the other end of the band 110 (the upper end of the band 110 in FIG. 2) on the side of the band 110 where the inflatable tube 120 is provided. The fastening member 130 can be fastened to any part on the entire surface of the band 110 where the inflatable tube 120 is not provided.

When the inflatable tube 120 is filled with air after the band 110 is wrapped around the compression target range and the band 110 is fastened by using the fastening member 130, the tight fitting device 100 compresses the muscles to apply the applied pressure to the compression target range. On the other hand, when the air is removed from the inflatable tube 120 at that state, the applied pressure that is applied by the tight fitting device 100 to the muscles becomes lower and lower.

The only requirement for the pressure regulating segment 200 is that it can supply a gas to the inflatable tube 120 and remove the gas from the inflatable tube 120. The pressure regulating segment 200 may have any one of possible configurations as long as it can supply a gas to the inflatable tube 120 and remove the gas from the inflatable tube 120.

Figure 5:
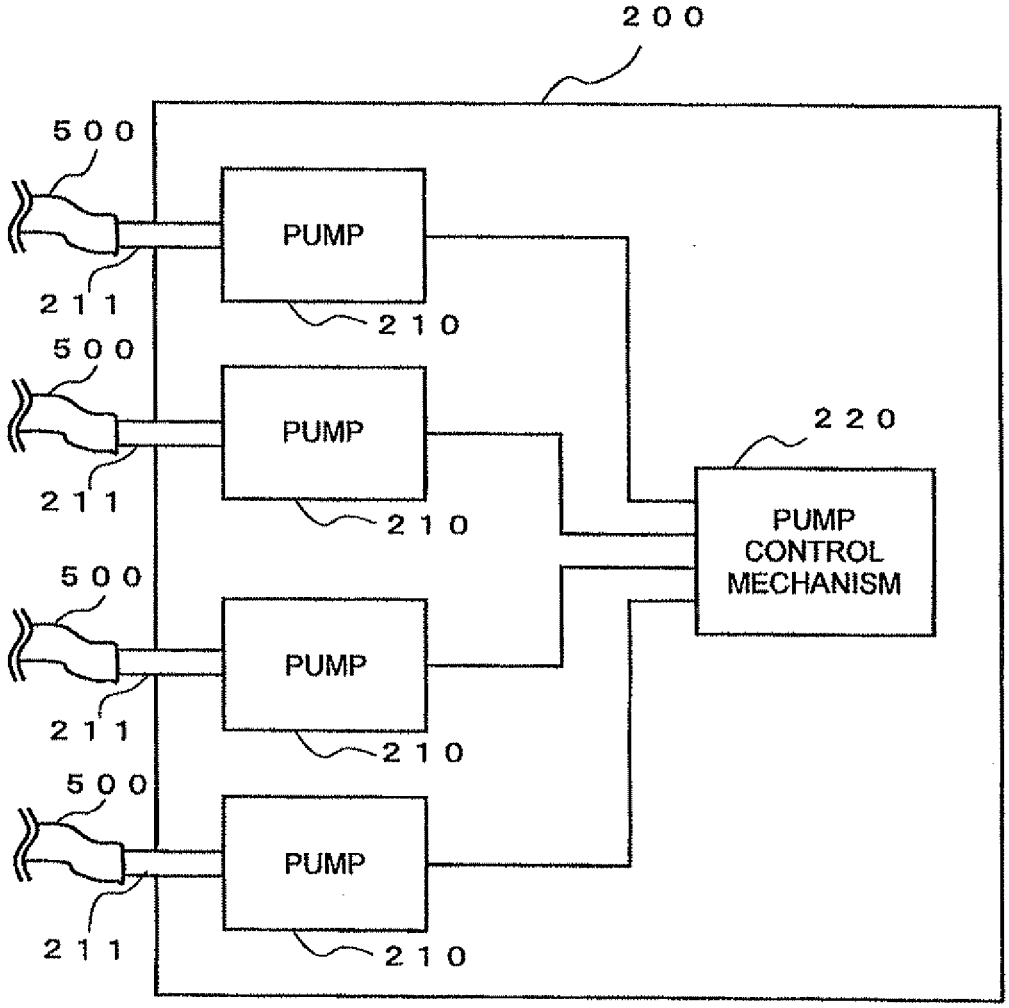
FIG. 5 is a view schematically showing an internal configuration of the pressure regulating segment included in the KAATSU training system in FIG. 1.

A configuration of an exemplified pressure regulating segment 200 is schematically shown in FIG. 5. As shown in FIG. 5, the pressure regulating segment 200 is composed of four pumps 210 and a pump control mechanism 220. These four pumps 210 are associated with four tight fitting devices 100, respectively.

The pump 210 has a function of sucking the surrounding gas (air in this embodiment) and supplying it to the outside of a pump connection inlet 211 which will be described below. It includes a valve which is not shown. By opening the valve, the gas in the pump 210 can be discharged to the outside. Each of the four pumps 210 has its own pump connection inlet 211 and is connected to the inflatable tube 120 through the connecting pipe 500 connected thereto and the connection inlet 121 itself. When the pump 210 forces the gas, the gas is introduced into the inflatable tube 120. When the pump 210 opens the valve, the gas can be removed from the inflatable tube 120.

The measuring segment 300 is a measuring segment which is used to measure at least one of a heart beat rate that represents the number of times your heart contracts, a pulse wave value that represents the amplitude of pulse waves, and an oxygen saturation value that represents the degree of oxygen saturation, of a user who receives the KAATSU training (sometimes merely referred to as a "user") when the tight fitting device 100 that is rest on a predetermined compression target range of the limb is applying the applied pressure to the compression target range. The measuring segment 300 may have any one of possible configurations as long as it can measure at least one of them. In addition, a part of the measuring segment 300 may be provided on the side of the control segment 400.

When the measuring segment 300 is for measuring the heart beat rate, it may be composed of, for example, a typical heart rate meter or pulse meter. More specifically, the measuring segment 300 may be a sensor that records the heart's electrical activity. With the sensor placed on the user, the measuring segment 300 can produce heart beat data indicating the heart beat rate.

When the measuring segment 300 is for measuring the pulse wave value, it may be composed of, for example, a typical sphygmograph. It should be noted that the term "pulse wave" refers to a wave of energy that is caused when the heart conracts, blood is ejected into the aorta, and a resulting change in arterial blood pressure travels towards the peripheral blood vessels. A volume pulse wave is detected as a cross-section change in blood vessel due to the wave of energy. A pressure pulse wave is detected as a pressure change in blood vessel. The measuring segment 300 may measure either one of them. For example, the measuring segment 300 may be composed of a pressure sensor that measures movement of skin at the skin surface caused by fluctuating blood flow to extract or contract the blood vessel, as a change in pressure received from the skin surface. With the sensor placed on the arm(s) or the leg(s) of the user on which the tight fitting device 100 is rest, the pulse wave value can be measured. Alternatively, the measuring segment 300 may be composed of an illumination lamp that illuminates blood vessels in a predetermined area such as a fingertip of the user with illumination light having infrared wavelengths, and a photosensor that measures a reflected beam produced when the illumination light collides with the blood vessel. In any event, when such the measuring segment 300 is used, the measuring segment 300 produces pulse wave data indicating the pulse wave value.

Unlike the heart beat rate and the oxygen saturation value, the pulse wave value may vary depending on sites on the body of the user. It is preferable that the measuring segment 300 for use in measuring the pulse wave value measure a pulse wave value at a position near the place where the tight fitting device 100 is wrapped around, on the arm or the leg on which the tight fitting device 100 is rest, or alternatively, at a position closer to the distal end of the arm or the leg than it. In addition, the number of the measuring segment 300 that measures the pulse wave value is not limited to one. The number may be identical to the number of the tight fitting devices 100.

When the measuring segment 300 is for measuring the oxygen saturation value, it may be composed of, for example, a typical pulse oximeter. With the pulse oximeter, the oxygen saturation value can be measured in a non-invasive manner. In this case, the measuring segment 300 comprises two illumination lamps one of which emits light having red wavelengths and the other of which emits light having infrared wavelengths, and a photosensor that measures such light after being transmitted through a predate ined area of the body of the user, such as a fingertip or an ear lobe. The oxygen saturation value measures the percentage of hemoglobin in the blood occupied by oxygen. The degree of redness of hemoglobin depends on how much oxygen it carries. Accordingly, the oxygen saturation value can be determined by means of measuring the degree of redness of blood using the photosensor. The measuring segment 300 in which the aforementioned pulse oximeter is used may be placed on a fingertip or an ear lobe of the user and generates oxygen saturation data indicating the oxygen saturation value.

It should be noted that the measuring segment 300 in this embodiment measures one of the heart beat rate, the pulse wave value, and the oxygen saturation value (hereinafter, sometimes collectively referred to as a "measurement target value") of the user who receives the KAATSU training. However, it may be a segment that can measure two or more of them. In such cases, the KAATSU training system can comprise two or more of the aforementioned measuring segment 300 that measures the heart beat rate, the aforementioned measuring segment 300 that measures the pulse wave value, and the aforementioned measuring segment 300 that measures the oxygen saturation value.

The measuring segment 300 in this embodiment can measure the measurement target value over time regardless of what measurement target value it measures. In other words, the measuring segment 300 can measure a possibly ever-changing measurement target value. The measuring segment 300 may continuously measure the measurement target value for a period of time. Alternatively, it may measure the measurement target value at a predetermined time interval or at a constant time interval (e.g., every ten seconds). The measuring segment 300 in this embodiment continuously measures the measurement target value for a period of time without any interruption.

The measuring segment 300 in this embodiment measures the aforementioned measurement target value regardless of what measurement target value it measures. It generates at least one of the heart beat data, the pulse wave data, and the oxygen saturation data (hereinafter, sometimes collectively referred to as a "measurement target value data") associated with the measurement target value, and sends the data to the control segment 400. The measuring segment 300 in this embodiment continuously generates the measurement target value data for a period of time without any interruption and sends the data to the control segment 400.

In order to achieve this, the measuring segment 300 comprises an output terminal 310 (see FIG. 1) and is adapted to send the measurement target value data to the control segment 400 via the output terminal 310. In this embodiment, the output terminal 310 is adapted to send the measurement target value data to the control segment 400 via a cable 700 having one end connected to the output terminal 310 and the other end connected to the control segment 400. It should be noted that the configuration to be used to transfer the measurement target value data is not limited thereto. For example, the measuring segment 300 may transmit data to the control segment 400 in a wireless manner by using light or radio waves.

The control segment 400 is for use in controlling the pressure regulating segment 200 according to the measurement target value data received from the measuring segment 300.

The control segment 400 comprises an input device S used to provide an input. The input device S in this embodiment consists of, but not limited to, a plurality of push buttons. What the data provided with the input device S is about is described below.

The control segment 400 also comprises a lamp L and a speaker which is not shown. The lamp L is any one of lamps that emit light when activated, but the lamp in this embodiment is an LED. The speaker is anyone of speakers thatproduce soundwhenactivated, but the speaker in this embodiment is the one that produces an alarm sound of about 70 db when activated.

Figure 6:
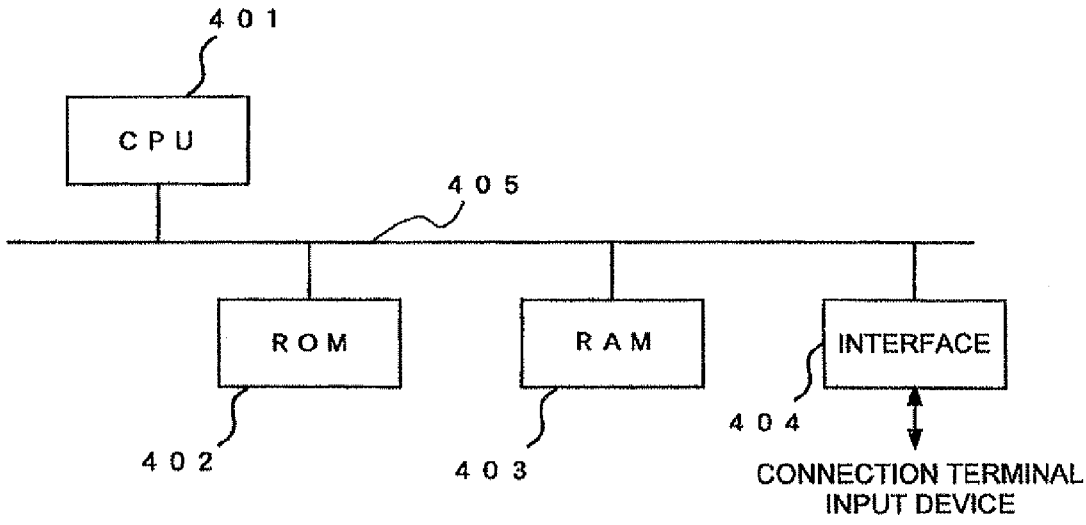
FIG. 6 is a hardware configuration of the control segment included in the KAATSU training system in FIG. 1.

An internal configuration of the control segment 400 is schematically shown in FIG. 6. The control segment 400 contains a computer wherein a CPU 401, an ROM 402, an RAM 403 and an interface 404 are connected to each other through a bus 405.

The CPU 401 is a central processing unit that controls the whole control segment 400. The ROM 402 records a program and data that are necessary for the processing described below in which the processing is carried out by the control segment 400. The CPU 401 executes the processing based on the program. The ROM 402 may be embodied by using a flash ROM. The RAM 403 is for providing a working area for the execution of the aforementioned program. The interface 404 is a device for the exchange of data between the outside. The interface 404 is connected to connection terminals (not shown) that can be connected to one end of the cable 600 the other end of which is connected to the pressure regulating segment 200, and connection terminals (not shown) that can be connected to the other end of the cable 700. The interface 404 is also connected to the input device S, the lamp L, and the speaker. The aforementioned measurement target value data supplied from the measuring segment 300 is received by the interface 404 through the cable 700. In addition, control data and stop data which are described below are sent from the interface 404 to the pressure regulating segment 200 through the cable 600. Furthermore, the input from the input device S is received by the interface 404. Below-described alarm data, which is generated at the same time when the stop data is generated, is supplied to the lamp L and the speaker via the interface 404.

Figure 7:
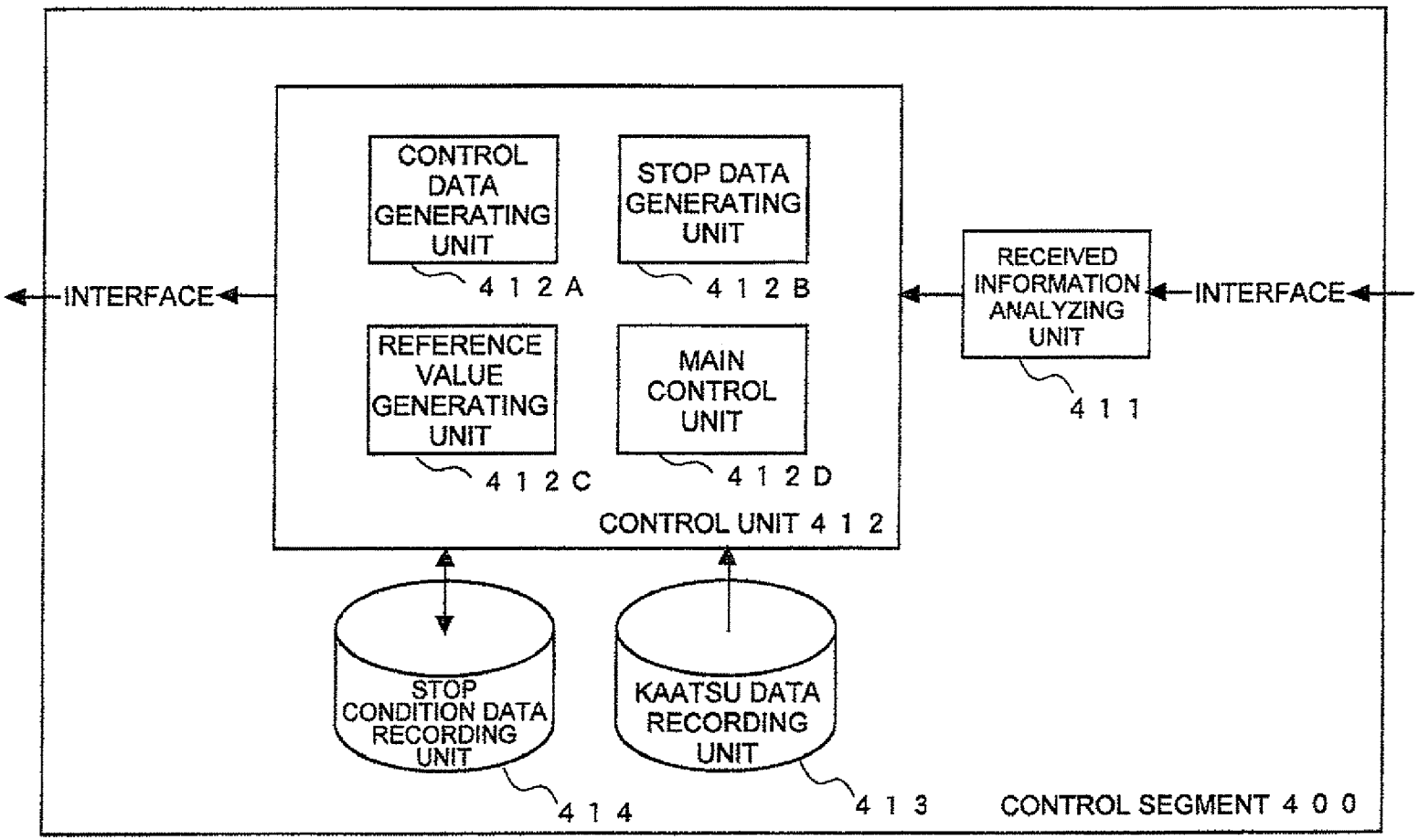
FIG. 7 is a view showing a functional block generated in the control segment included in the KAATSU training system in FIG. 1.

As the CPU 401 executes the aforementioned program, a functional block as shown in FIG. 7 is created within the control segment 400.

The control segment 400 includes a received information analyzing unit 411, a control unit 412, a KAATSU data recording unit 413, and a stop condition data recording unit 414.

The received information analyzing unit 411 receives the measurement target value data or an input supplied via the input device S, from the interface 404 and analyzes the details thereof. Data representing the result of analysis by the received information analyzing unit 411 are supplied to the control unit 412.

The KAATSU data recording unit 413 records KAATSU data.

The stop condition data recording unit 414 records stop condition data.

The KAATSU data and the stop condition data will be described below.

The control unit 412 has, as its main functions, a function to generate the control data for use in controlling the pressure regulating segment 200 in accordance with the data received from the received information analyzing unit 411, and a function to generate the stop data in accordance with the data received from the received information analyzing unit 411.

The control unit 412 includes a control data generating unit 412A, a stop data generating unit 412B, a reference value generating unit 412C, and a main control unit 412D.

The control data generating unit 412A in this embodiment is adapted to generate the control data. The control data generating unit 412A uses the KAATSU data recorded on the KAATSU data recording unit 413 when it generates the control data.

The stop data generating unit 412B in this embodiment is adapted to generate the stop data. The stop data generating unit 412B uses the stop condition data recorded on the stop condition data recording unit 414 when it generates the stop data. The control unit 412 is adapted to generate alarm data at the same time when it generates the stop data in this embodiment, although the concurrent generation thereof is not necessarily required.

How the control data, the stop data, and the alarm data are generated at which timing will be described in detail later.

The control unit 412 is adapted to send the control data generated by the control data generating unit 412A and the stop data generated by the stop data generating unit 412E to the interface 404.

The KAATSU data is the one that defines how the pressure regulating segment 200 is controlled in order to provide the KAATSU training. The KAATSU data is specific for the respective KAATSU training users in many cases. The KAATSU data is the one that indicates, but not limited to, association between the elapsed time from the beginning and an ideal air pressure within the inflatable tube 120 at each point of time when the KAATSU training is provided. In other words, the KAATSU data defines the pressure to be applied to the compression target range by the tight fitting device 100 for the KAATSU training, in association with the time elapsed since the beginning of the KAATSU training.

The control data generating unit 412A is adapted to read the KAATSU data from the KAATSU data recording unit 413 when the KAATSU training is provided, and generate the control data so that the inflatable tube 120 applies a compression force based on the KAATSU data to the compression target range. The control data is transmitted therefrom through the interface 404 to the pump control mechanism 220 within the pressure regulating segment 200. The pump control mechanism 220 controls the pumps 210 according to the control data so that the pumps 210 supply the air to the inflatable tube 120 or the pumps 210 remove the air from the inflatable tube 120.

In this way, the air pressure within the inflatable tube 120 is adjusted appropriately by means of the control data generated by the control data generating unit 412A. In addition, this in turn adjusts the compression force applied by the tight fitting device 100 to the compression target range, according to the KAATSU data.

The stop condition data is the one that indicates conditions where the ongoing KAATSU training should be stopped.

In brief, the stop condition data in this embodiment specifies the criteria on which it is determined whether the measurement target value data indicate that the user should not continue the KAATSU training, in order to control the pressure regulating segment 200 to remove the air from the inflatable tube 120 when the measurement target value data, which are either the heart beat data, the pulse wave data, or the oxygen saturation data, indicate that the user should not continue the KAATSU training.

[When Measurement Target Value Data is Heart Beat Data]

When the measurement target value data is the heart beat data, the stop condition data is as follows.

<When Reference Heart Beat Rate is Used>

A reference heart beat rate is a given heart beat rate. In this embodiment, the heart beat rate is defined as the heart beat rate per a unit time (in this embodiment, one minute).

When the stop condition data is generated by using the reference heart beat rate, the stop condition data generates the stop data when the heart beat rate of the user falls below the reference heart beat rate.

The reference heart beat rate herein is such heart beat rate that the user should not continue the KAATSU training when the heart beat rate of the user falls below it. The reference heart beat rate may have a fixed value. For example, the reference heart beat rate may be fixed at 50 beats per 1 minute. When the reference heart beat rate is fixed as described above, the reference heart beat rate will be identical for all users.

Depending on factors such as the age, physical strength, and sex of the user, the heart beat rate below which the user should not continue the KAATSU training also varies. Taking this into account, safety can be maintained and it is convenient if the reference heart beat rate is determined for a user who receives the KAATSU training by a doctor, a training expert who has a wealth of knowledge about the KAATSU training, or the user himself or herself who receives the KAATSU training under supervision by an expert. The KAATSU training system in this embodiment allows this by using the input device S. This KAATSU training system allows the user for example to enter an appropriate reference heart beat rate as his or her own reference heart beat rate that is taught by a person who has a wealth of knowledge about the KAATSU training, by means of using the input device S. The input from the input device S is supplied to the reference value generating unit 412C in the control unit 412 through the interface 404 and the received information analyzing unit 411. The reference value generating unit 412C has a function to determine the reference heart beat rate based on the input from the input device S and send it to the stop condition data recording unit 414. The reference heart beat rate sent from the reference value generating unit 412C is received by the stop condition data recording unit 414 and is recorded thereon as a part of the stop condition data.

The manual setting of the reference heart beat rate as described above has an advantage in that the reference heart beat rate can be determined on a case-by-case basis for each user who receives the KAATSU training. On the other hand, the KAATSU training system in this embodiment can provide following processing to determine the reference heart beat rate automatically. The control data generating unit 412A of this KAATSU training system determines the reference heart beat rate so that it falls within the range of 85% to 95% of the heart beat rate of the user at rest. More specifically, it determines the reference heart beat rate at 90% of the heart beat rate of the user at rest (provided that if the reference heart beat rate determined in this manner includes a fraction, the fraction is rounded down, up or off to the nearest whole number as the reference heart beat rate; a fraction is rounded down in this embodiment). What is important is which heart beat rate the control data generating unit 412A considers as the heart beat rate of the user at rest. For example, the heart beat rate of the user at rest may be the heart beat rate within an appropriate time interval (e.g., 1 minute) after the beginning of the KAATSU training (more specifically, after the air pressure within the inflatable tube 120 reaches a pressure that is suitable for the KAATSU training; the same applies to similar cases below). Alternatively, the heart beat rate of the user at rest may be determined based on the record(s) during past KAATSU training periods. If this applies, the stop data generating unit 412B has a function to record the history of the heart beat rate during the past KAATSU training periods of the user. At any event, calculation of the reference heart beat rate from the heart beat rate of the user at rest is performed by the aforementioned reference value generating unit 412C. The reference value generating unit 412C determines the reference heart beat rate based on the input from the input device S and sends it to the stop condition data recording unit 414. The reference heart beat rate that the reference value generating unit 412C has sent is received by the stop condition data recording unit 414 and is recorded thereon as a part of the stop condition data.

<When Rapid Drop of Heart Beat Rate is Monitored>

When the stop condition data is generated by monitoring a rapid drop of the heart beat rate, the stop condition data generates the stop data when the heart beat rate of the user increases or decreases by 10% or more as compared to the heart beat rate at a certain point of time within an appropriate time interval (in this embodiment within 30 seconds) of not longer than 60 seconds.

In order for the stop data generating unit 412B to generate the stop data based on such stop condition data, the stop data generating unit 412B is required to have a function to continuously record the heart beat rate of the user. The stop data generating unit 412B in this embodiment has a function to continuously record the heart beat rate of the user for at least last 30 seconds and a function to monitor the recorded heart beat rates in order to determine whether they exhibit any changes as described above.

In this case, two parameters about time and percentage, i.e., in how many seconds and at how much percentage the heart beat rate fluctuates, may be varied through the operation of the input device S.

<Summary of the Case Where Measurement Target Value Data is Heart Beat Data>

In this embodiment, when the measurement target value data is the heart beat data, the stop data is generated in one of the following modes:

(Heart Beat Rate—1) If the heart beat rate of the user falls below a fixed reference heart beat rate;

(Heart Beat Rate—2) If the heart beat rate of the user falls below a manually-specified reference heart beat rate;

(Heart Beat Rate—3) If the heart beat rate of the user falls below an automatically-specified reference heart beat rate;

(Heart Beat Rate—4) If the heart beat rate of the user fluctuates by 10% or more in 30 seconds, from the heart beat rate at a certain point of time.

It should be noted that the choice of the modes is determined according to the input from the input device S in this KAATSU training system. The input from the input device S is transmitted to the main control unit 412D in the control unit 412 through the interface 404 and the received information analyzing unit 411. The main control unit 412D notifies the mode being selected at that point, to the stop data generating unit 412B.

[When Measurement Target Value Data is Pulse Wave Data]

When the measurement target value data is the pulse wave data, the stop condition data is as follows.

<When Reference Pulse Wave Value is Used>

A reference pulse wave value is a given pulse wave value. The pulse wave value repeatedly increases and decreases in a cycle of about 1 seconds in cooperation with the heart beat. In this embodiment, the pulse wave value is defined as the difference between the adjacent upper and lower peaks of the increasing-and-decreasing pulse wave.

When the stop condition data is generated by using the reference pulse wave value, the stop condition data generates the stop data when the pulse wave value of the user falls below the reference pulse wave value.

The reference pulse wave value herein is such pulse wave value that the user should not continue the KAATSU training when the pulse wave value of the user falls below it. The reference pulse wave value may have a fixed value. The pulse wave may be one of various types such as velocity pulse wave and acceleration pulse wave. The reference pulse wave value may be determined appropriately depending on the respective cases. When the reference pulse wave value is fixed as described above, the reference pulse wave value will be identical for all users.

Depending on factors such as the age, physical strength, and sex of the user, the pulse wave value below which the user should not continue the KAATSU training also varies. Taking this into account, it is safe and convenient if the reference pulse wave value is determined for a user who receives the KAATSU training by a doctor, a training expert who has a wealth of knowledge about the KAATSU training, or the user himself or herself who receives the KAATSU training under supervision by an expert. The KAATSU training system in this embodiment allows this by using the input device S. This KAATSU training system allows the user for example to enter an appropriate reference pulse wave value as his or her own reference pulse wave value that is taught by a person who has a wealth of knowledge about the KAATSU training, by means of using the input device S. The input from the input device S is supplied to the reference value generating unit 412C through the interface 404 and the received information analyzing unit 411. The reference value generating unit 412C has a function to determine the reference pulse wave value based on the input from the input device S and send it to the stop condition data recording unit 414. The reference pulse wave value sent from the reference value generating unit 412C is received by the stop condition data recording unit 414 and is recorded thereon as a part of the stop condition data.

The manual setting of the reference pulse wave value as described above has an advantage in that the reference pulse wave value can be determined on a case-by-case basis for each user who receives the KAATSU training. On the other hand, the KAATSU training system in this embodiment can provide following processing to determine the reference pulse wave value automatically. The control data generating unit 412A of this KAATSU training system determines the reference pulse wave value so that it falls within the range of 85% to 95% of the pulse wave value of the user at rest. For example, the reference pulse wave value is determined at 90% of the pulse wave value of the user at rest. What is important is which pulse wave value the control data generating unit 412A considers as the pulse wave value of the user at rest. For example, the pulse wave value of the user at rest may be the pulse wave value within an appropriate time interval (e.g., 1 minute) after the beginning of the KAATSU training. Alternatively, the pulse wave value of the user at rest may be determined based on the record(s) during past KAATSU training periods. If this applies, the stop data generating unit 412B has a function to record the history of the pulse wave value during the past KAATSU training periods of the user. At any event, calculation of the reference pulse wave value from the pulse wave value of the user at rest is performed by the aforementioned reference value generating unit 412C. The reference value generating unit 412C determines the reference pulse wave value based on the input from the input device S and sends it to the stop condition data recording unit 414. The reference pulse wave value that the reference value generating unit 412C has sent is received by the stop condition data recording unit 414 and is recorded thereon as a part of the stop condition data.

<When Rapid Drop of Pulse Wave Value is Monitored>

When the stop condition data is generated by monitoring a rapid drop of the pulse wave value, the stop condition data generates the stop data when the pulse wave value of the user is increased or decreased by 10% or more as compared to the pulse wave value at a certain point of time within an appropriate time interval (in this embodiment within 30 seconds) of not longer than 60 seconds.

In order for the stop data generating unit 412B to generate the stop data based on such stop condition data, the stop data generating unit 412B is required to have a function to continuously record the pulse wave value of the user. The stop data generating unit 412B in this embodiment has a function to continuously record the pulse wave value of the user for at least last 30 seconds and a function to monitor the recorded pulse wave values in order to determine whether they exhibit any changes as described above.

In this case, two parameters about time and percentage, i.e., in how many seconds and at how much percentage the pulse wave value fluctuates, may be varied through the operation of the input device S.

<Summary of the Case Where Measurement Target Value Data is Pulse Wave Data>

In this embodiment, when the measurement target value data is the pulse wave data, the stop data is generated in one of the following modes:

(Pulse Wave Value—1) If the pulse wave value of the user falls below a fixed reference pulse wave value;

(Pulse Wave Value—2) If the pulse wave value of the user falls below a manually-specified reference pulse wave value;

(Pulse Wave Value—3) If the pulse wave value of the user falls below an automatically-specified reference pulse wave value;

(Pulse Wave Value—4) If the pulse wave value of the user fluctuates by 10% or more in 30 seconds, from the pulse wave value at a certain point of time.

It should be noted that the choice of the modes is determined according to the input from the input device S in this KAATSU training system. The input from the input device S is transmitted to the main control unit 412D in the control unit 412 through the interface 404 and the received information analyzing unit 411. The main control unit 412D notifies the mode being selected at that point, to the stop data generating unit 412B.

[When Measurement Target Value Data is Oxygen Saturation Data]

When the measurement target value data is the oxygen saturation data, the stop condition data is as follows.

<When Reference Oxygen Saturation Value is Used>

A reference oxygen saturation value is a given oxygen saturation value.

When the stop condition data is generated by using the reference oxygen saturation value, the stop condition data generates the stop data when the oxygen saturation value of the user falls below the reference oxygen saturation value.

The reference oxygen saturation value herein is such oxygen saturation value that the user should not continue the KAATSU training when the oxygen saturation value of the user falls below it. The reference oxygen saturation value may have a fixed value. For example, a fixed reference oxygen saturation value of 96% may be determined. When the reference oxygen saturation value is fixed as described above, the reference oxygen saturation value will be identical for all users.

Depending on factors such as the age, physical strength, and sex of the user, the oxygen saturation value below which the user should not continue the KAATSU training also varies. Taking this into account, it is safe and convenient if the reference oxygen saturation value is determined for a user who receives the KAATSU training by a doctor, a training expert who has a wealth of knowledge about the KAATSU training, or the user himself or herself who receives the KAATSU training under supervision by an expert. The KAATSU training system in this embodiment allows this by using the input device S. This KAATSU training system allows the user for example to enter an appropriate reference oxygen saturation value as his or her own reference oxygen saturation value that is taught by a person who has a wealth of knowledge about the KAATSU training, by means of using the input device S. The input from the input device S is supplied to the reference value generating unit 412C through the interface 404 and the received information analyzing unit 411. The reference value generating unit 412C has a function to determine the reference oxygen saturation value based on the input from the input device S and send it to the stop condition data recording unit 414. The reference oxygen saturation value sent from the reference value generating unit 412C is received by the stop condition data recording unit 414 and is recorded thereon as a part of the stop condition data.

The manual setting of the reference oxygen saturation value as described above has an advantage in that the reference oxygen saturation value can be determined on a case-by-case basis for each user who receives the KAATSU training. On the other hand, the KAATSU training system in this embodiment can provide following processing to determine the reference oxygen saturation value automatically. The control data generating unit 412A of this KAATSU training system determines the reference oxygen saturation value so that it falls within the range of 95% to 99% of the oxygen saturation value of the user at rest. For example, the reference oxygen saturation value is determined at 97% of the oxygen saturation value of the user at rest. What is important is which oxygen saturation value the control data generating unit 412A considers as the oxygen saturation value of the user at rest. For example, the oxygen saturation value of the user at rest may be the oxygen saturation value within an appropriate time interval (e.g., 1 minute) after the beginning of the KAATSU training. Alternatively, the oxygen saturation value of the user at rest may be determined based on the record(s) during past KAATSU training periods. If this applies, the stop data generating unit 412B has a function to record the history of the oxygen saturation value during the past KAATSU training periods of the user. At any event, calculation of the reference oxygen saturation value from the oxygen saturation value of the user rest is performed by the aforementioned reference value generating unit 412C. The reference value generating unit 412C determines the reference oxygen saturation value based on the input from the input device S and sends it to the stop condition data recording unit 414. The reference oxygen saturation value that the reference value generating unit 412C has sent is received by the stop condition data recording unit 414 and is recorded thereon as a part of the stop condition data.

<When Rapid Drop of Oxygen Saturation Value is Monitored>

When the stop condition data is generated by monitoring a rapid drop of the oxygen saturation value, the stop condition data generates the stop data when the oxygen saturation value of the user is increased or decreased by 3% or more as compared to the oxygen saturation value at a certain point of time within an appropriate time interval (in this embodiment within 30 seconds) of not longer than 60 seconds.

In order for the stop data generating unit 412B to generate the stop data based on such stop condition data, the stop data generating unit 412B is required to have a function to continuously record the oxygen saturation value of the user. The stop data generating unit 412B in this embodiment has a function to continuously record the oxygen saturation value of the user for at least last 30 seconds and a function to monitor the recorded oxygen saturation values in order to determine whether they exhibit any changes as described above.

In this case, two parameters about time and percentage, i.e., in how many seconds and at how much percentage the oxygen saturation value fluctuates, may be varied through the operation of the input device S.

<Summary of the Case where Measurement Target Value Data is Oxygen Saturation Data>

In this embodiment, when the measurement target value data is the oxygen saturation data, the stop data is generated in one of the following modes:

(Oxygen Saturation Value—1) If the oxygen saturation value of the user falls below a fixed reference oxygen saturation value;

(Oxygen Saturation Value—2) If the oxygen saturation value of the user falls below a manually-specified reference oxygen saturation value;

(Oxygen Saturation Value—3) If the oxygen saturation value of the user falls below an automatically-specified reference oxygen saturation value;

(Oxygen Saturation Value—4) If the oxygen saturation value of the user fluctuates by 10% or more in 30 seconds, from the oxygen saturation value at a certain point of time.

It should be noted that the choice of the modes is determined according to the input from the input device S in this KAATSU training system. The input from the input device S is transmitted to the main control unit 412D in the control unit 412 through the interface 404 and the received information analyzing unit 411. The main control unit 412D notifies the mode being selected at that point, to the stop data generating unit 412B.

During the KAATSU training, the stop data generating unit 412B receives the measurement target value data supplied from the measuring segment 300 and monitors the measurement target value data in order to determine whether it meets the condition indicated by the stop condition data. The stop condition data varies depending on whether the measurement target value data is the heart beat data, the pulse wave data, or the oxygen saturation data, and depending on which one of the aforementioned modes is selected at that point, for the measurement target value data being used. Accordingly, the stop data generating unit 412B monitors the measurement target value data in order to determine whether it meets the condition indicated by the stop condition data in the mode selected at that point notified by the main control unit 412D as described above.

The stop data generating unit 412B generates the stop data and the alarm data and sends them to the interface 404 when it determines that the measurement target value data meets the condition indicated by the stop condition data during the aforementioned monitoring. The stop data supplied to the interface 404 is directed to the pump control mechanism 220 in the pressure regulating segment 200. The alarm data is supplied to the lamp L and the speaker. In response to this, the lamp L produces a light, and the speaker produces an alarm.

The stop data is the one that is used by the pump control mechanism 220 that has received it, to direct the pumps 210 to remove the air. More specifically, the stop data is the one that is used by the pump control mechanism 220 that has received it, to direct the pumps 210 to remove the air in such a manner that the pressure in the inflatable tube 120 at that point of time is reduced (in this embodiment, the gas pressure in the inflatable tube 120 is reduced from the pressure at that time by 80% or more of the difference between the pressure at that time and the atmospheric pressure). The stop data may be the one that is used by the pump control mechanism 220 to direct the pumps 210 to carry out an operation to reduce the pressure in the inflatable tube 120 from the pressure at that time by 90% or more of the difference between the pressure at that time and the atmospheric pressure, in order to provide higher safety of the user. Alternatively, it may be the one that is used by the pump control mechanism 220 to direct the pumps 210 to carry out an operation to reduce the pressure in the inflatable tube 120 to a pressure generally identical to the atmospheric pressure. The pump control mechanism 220 that has received the stop data directs the pumps 210 to remove the air in the inflatable tube 120. This reduces the air pressure in the inflatable tube 120, based on the stop data. As a result, the compression force applied by the tight fitting device 100 to the compression target range is also reduced.

As will be described below, the stop data generating unit 412B may continue the aforementioned monitoring even after the air in the inflatable tube 120 is removed based on the stop data supplied to the pump control mechanism 220.

Next, how the KAATSU training system is used is described briefly.

First, the four tight fitting devices 100 are wrapped around the compression target range on the limbs of the user who receives the KAATSU training. In this embodiment, two tight fitting devices 100A for arms are rest on the arms and two tight fitting devices 100E for legs are rest on the legs. More specifically, the inflatable tube 120 is encircled once around the compression target range, and the excessive length of the band 110 is further encircled two times around it. With this state, the fastening member 130 is used to fasten the end of the band 110. Then, the tight fitting devices 100A or 100B apply a given compression force to the arms or the legs, respectively. The compression force does not reach a pressure that is appropriate for the user to receive the KAATSU training.

Next, the measuring segments 300 are placed on appropriate positions of the body of the user who receives the KAATSU training. As described above, the position where each measuring segment 300 is placed depends on the measurement target value to be measured thereby, so that they should be placed on appropriate positions of the body of the user.

Next, the four tight fitting devices 100 are connected to the pressure regulating segment 200 through the respective connecting pipes 500. The measuring segment 300 is connected to the control segment 400 through the cable 700. The control segment 400 and the pressure regulating segment 200 are connected to each other through the cable 600.

With this state, the input device S is used to enter an input. The input provided by using the input device S is for use in choosing the mode to be used to generate the stop condition data as described above. Depending on the mode selected for the stop condition data, it becomes necessary to enter either the reference heart beat rate, the reference pulse wave value, or the reference oxygen saturation value. One of them is provided if necessary.

Next, the KAATSU training is started through the operation of the input device S.

The input provided by the operation of the input device S is transmitted to the main control unit 412D in the control unit 412 via the interface 404 and the received information analyzing unit 411. The main control unit 412D sends an instruction to the control data generating unit 412A to start the KAATSU training. In response to this, the control data generating unit 412A generates the control data and sends it to the pump control mechanism 220 in the pressure regulating segment 200 via the interface 404. The pumps 210 are driven under the control of the pump control mechanism 220 and adjust the pressure in the inflatable tube 120 appropriately as described above. As a result, the compression target range on which the tight fitting device 100 is placed is applied with an appropriate applied pressure by the tight fitting device 100 With this state, the user who receives the KAATSU training may be at rest or do exercises. Note that if one of the modes (Heart Beat Rate—3), (Pulse Wave Value—3), and (Oxygen Saturation Value—3) is performed, it is preferable that the user is at rest without significantly affecting one of the heart beat rate, the pulse wave value, and the oxygen saturation value, respectively, that is used to generate the stop data during the time when the stop data is generated.

When the KAATSU training is started through the operation of the input device S, the main control unit 412D sends an instruction to the stop data generating unit 412B to begin the monitoring of the measurement target value data that is supplied from the measuring segment 300. In response to this, the stop data generating unit 412B reads the stop condition data for the selected mode, from the stop condition data recording unit 414, and begins to monitor the measurement target value data to determine whether it meets the condition specified by the stop condition data for the selected mode. As described above, depending on the selected mode, the measurement target value data should be monitored before the beginning of the KAATSU training. In such a case, the stop data generating unit 412B begins the monitoring of the measurement target value data when, for example, an input is given via the input device S to specify the mode to be used to generate the stop condition data.

During the KAATSU training, the stop data generating unit 412B monitors the measurement target value data to determine whether it meets the condition specified by the stop condition data for the selected mode.

If the measurement target value data does not meet the condition specified by the stop condition data for the selected mode until the end of the KAATSU training, the KAATSU training is merely finished. The KAATSU training is finished in such a manner that the control data generating unit 412A sends the control data to the pump control mechanism 220, the control data being for directing the pump control mechanism 220 to operate the pumps 210 in order to remove the air from the inflatable tube 120.

If the stop data generating unit 412B determines that the measurement target value data meets the condition specified by the stop condition data for the selected mode, before the end of the KAATSU training, the stop data generating unit 412E generates the stop data. The stop data is transmitted to the pump control mechanism 220 in the pressure regulating segment 200 via the interface 404. The pumps 210 are driven under the control of the pump control mechanism 220 to reduce the pressure in the inflatable tube 120 as described above. This reduces the applied pressure that is applied by the tight fitting device 100 to the compression target range on which the tight fitting device 100 is placed, to stop the KAATSU training. Concurrently, the alarm data, which has been generated at the same time as the stop data, causes the lamp L and the speaker to produce a light and an alarm, respectively. The light from the lamp L and the alarm out of the speaker are stopped after a predetermined time interval has elapsed. Alternatively, the light from the lamp L and the alarm out of the speaker may be stopped by means of someone's operation using the input device S.

KAATSU training system may be adapted to merely terminate the KAATSU training if the stop data is generated. On the other hand, the KAATSU training system may be adapted to restart the KAATSU training if a predetermined condition is satisfied. The predetermined condition may be, for example, the lapse of a time period that is long enough that one can determine that the safety of the user who receives the KAATSU training is ensured after the generation of the stop data. The KAATSU training system in this embodiment adopts this approach.

In the KAATSU training system in this embodiment, the stop data generating unit 412B is adapted to send data indicating that the stop data has been generated, to the control data generating unit 412A. In response to this, the control data generating unit 412A terminates the generation of the control data. On the other hand, the stop data generating unit 412B in the KAATSU training system in this embodiment is adapted to continuously monitor the measurement target value data after the stop data has been generated, to determine whether it meets the condition specified by the stop condition data. If the measurement target value data that once has met the condition specified by the stop condition data fails to meet the condition specified by the stop condition data, the stop data generating unit 412B sends data indicative of that to the control data generating unit 412A. In response to this, the control data generating unit 412A restarts the generation of the control data. In this manner, in this embodiment, the KAATSU training that has temporarily stopped is restarted. It should be noted that the KAATSU training may be restarted regardless of the measurement target value data after the lapse of an appropriate period of time since the KAATSU training is stopped (e.g., when the stop data is generated). In this case, after the lapse of a predetermined period of time, e.g., 120 seconds since it receives the data indicating that the stop data has been generated from the stop data generating unit 412B, the control data generating unit 412A restarts the generation of the control data suspended because of the reception of the aforementioned data.

It should be noted that there is one measuring segment 300 in this embodiment, but two or more measuring segments 300 may be included in the KAATSU training system to measure two or more different measurement target values.

In this case, the stop data generating unit 412B is adapted to monitor each of different measurement target value data that are supplied from the two or more measuring segments 300 to determine whether each of the data meets the condition specified by the stop condition data, and is also adapted to generate the stop data when one of the measurement target value data meets the condition, or when all of the measurement target value data meet the condition.

The invention calimed is:

1. A training apparatus which is used in combination with:

a tight fitting device comprising a band having the length that is enough to be wrapped around a predetermined range of one of the limbs of a user who receives training; an inflatable tube provided in or on said band, said inflatable tube being of air-tight construction; and fastening means for fastening said band on said predetermined range with said band being wrapped around said predetermined range of one of the limbs, said fastening means being provided on said band, said tight fitting device being adapted to apply a predetermined applied pressure to said predetermined range of said limb by means of filling said inflatable tube with a gas, the predetermined applied pressure being for restricting the blood flow into the limb distal to said predetermined range; and measuring means for measuring at least one of a physical quantity that varies in conjunction with a pulse wave in said limb on which said tight fitting device is placed, to generate pulse wave data associated with a pulse wave value that represents the amplitude of pulse waves measured at a position near the top of the one of the limbs where the tight fitting device is wrapped around;

the training apparatus being adapted to control said applied pressure;

the training apparatus comprising:

pressure regulating means that is capable of forcing a gas into said inflatable tube and removing the gas from said inflatable tube, via a predetermined tube; and control means for controlling said pressure regulating means in order to change said applied pressure;

said control means being adapted to receive said pulse wave data from said measuring means, and adapted to control said pressure regulating means in such a manner that said pressure regulating means removes the gas from said inflatable tube to the degree that can ensure the safety of the user, when the pulse wave value of the user falls below a reference pulse wave value.

2. The training apparatus as claimed in claim 1, wherein said control means is adapted to control said pressure regulating means in such a manner that said pressure regulating means reduces the gas pressure in said inflatable tube from the pressure at that point of time by 80% or more of the difference between the pressure at that point of time and the atmospheric pressure, when said pulse wave data that has been received indicates that said user should not continue the training.

3. The training apparatus as claimed in claim 1 or 2, wherein said control means is adapted to control said pressure regulating means in such a manner that said pressure regulating means reduces the gas pressure in said inflatable tube to a pressure generally identical to the atmospheric pressure, when said pulse wave data that has been received indicates that said user should not continue the training.

4. The training apparatus as claimed in claim 1, wherein said control means is adapted to control said pressure regulating means in such a manner that said pressure regulating means removes the gas from said inflatable tube to the degree that can ensure the safety of the user when said pulse wave data that has been received indicates that said user should not continue the training, and adapted to control said pressure regulating means in such a manner that said pressure regulating means supplies the gas into said inflatable tube to thereby restart the training after the lapse of a certain period of time.

5. The training apparatus as claimed in claim 1, wherein said control means is adapted to control said pressure regulating means in such a manner that said pressure regulating means removes the gas from said inflatable tube to the degree that can ensure the safety of the user when said pulse wave data that has been received indicates that said user should not continue the training, and adapted to control said pressure regulating means in such a manner that said pressure regulating means supplies the gas into said inflatable tube to thereby restart the training if said pulse wave data which has indicated that the training should not be continued, no longer indicates that the training should not be continued.

6. The training apparatus as claimed in claim 1, wherein said measuring means is adapted to generate the pulse wave data associated with the pulse wave value by means of measuring the physical quantity that varies in conjunction with the pulse wave; and wherein said control means is adapted to control said pressure regulating means in such a manner that said pressure regulating means removes the gas from said inflatable tube to the degree that can ensure the safety of the user when said pulse wave data that has been received from said measuring means indicates that the pulse wave value is increased or decreased by 10% or more as compared to the pulse wave value at a certain point of time, within 60 seconds.

7. The training apparatus as claimed in claim 1, wherein said measuring means is adapted to generate the pulse wave data associated with the pulse wave value by means of measuring the physical quantity that varies in conjunction with the pulse wave.

8. The training apparatus as claimed in claim 7, further comprising input means for use in providing data associated with said reference pulse wave value, said control means being adapted to determine said reference pulse wave value according to the data provided by using said input means.

9. The training apparatus as claimed in claim 7, wherein said control means is adapted to determine said reference pulse wave value so that it falls within the range of 85% to 95% of said pulse wave value of the user at rest.

10. A control method that is carried out by control means of a training apparatus, the training apparatus being used in combination with:

a tight fitting device comprising a band having the length that is enough to be wrapped around a predetermined range of one of the limbs of a user who receives training; an inflatable tube provided in or on said band, said inflatable tube being of air-tight construction; and fastening means for fastening said band on said predetermined range with said band being wrapped around said predetermined range of one of the limbs, said fastening means being provided on said band, said tight fitting device being adapted to apply a predetermined applied pressure to said predetermined range of said limb by means of filling said inflatable tube with a gas, the predetermined applied pressure being for restricting the blood flow into the limb distal to said predetermined range; and a measuring segment for measuring a physical quantity that varies in conjunction with a pulse wave, in said limb on which said tight fitting device is placed, to generate pulse wave data associated with a pulse wave value that represents the amplitude of pulse waves;

the training apparatus comprising pressure regulating means that is capable of forcing a gas into said inflatable tube and removing the gas from said inflatable tube, via a predetermined tube; and said control means for controlling said pressure regulating means in order to change said applied pressure, said control means comprising the steps of:

receiving said pulse wave data from said measuring segment, wherein said pulse wave is detected at a position near the top of the one of the limbs where the tight fitting device is wrapped around; and controlling said pressure regulating means in such a manner that said pressure regulating means removes the gas from said inflatable tube to the degree that can ensure the safety of the user, when the pulse wave value of the user falls below a reference pulse wave value.

11. A training system comprising:

a tight fitting device comprising a band having the length that is enough to be wrapped around a predetermined range of one of the limbs of a user who receives training; an inflatable tube provided in or on said band, said inflatable tube being of air-tight construction; and fastening means for fastening said band on said predetermined range with said band being wrapped around said predetermined range of one of the limbs, said fastening means being provided on said band, said tight fitting device being adapted to apply a predetermined applied pressure to said predetermined range of said limb by means of filling said inflatable tube with a gas, the predetermined applied pressure being for restricting the blood flow into the limb distal to said predetermined range;

pressure regulating means that is capable of forcing a gas into said inflatable tube and removing the gas from said inflatable tube, via a predetermined tube;

control means for controlling said pressure regulating means in order to change said applied pressure; and measuring means for measuring a physical quantity that varies in conjunction with a pulse wave in said limb on which said tight fitting device is placed, to generate pulse wave data associated with a pulse wave value that represents the amplitude of pulse waves measured at a position near the top of the one of the limbs where the tight fitting device is wrapped around;

said control means being adapted to receive said pulse wave data from said measuring means, and adapted to control said pressure regulating means in such a manner that said pressure regulating means removes the gas from said inflatable tube to the degree that can ensure the safety of the user, when the pulse wave value of the user falls below a reference pulse wave value.

12. A training apparatus which is used in combination with:

a tight fitting device comprising a band having the length that is enough to be wrapped around a predetermined range of one of the limbs of a user who receives training; an inflatable tube provided in or on said band, said inflatable tube being of air-tight construction; and fastening means for fastening said band on said predetermined range with said band being wrapped around said predetermined range of one of the limbs, said fastening means being provided on said band, said tight fitting device being adapted to apply a predetermined applied pressure to said predetermined range of said limb by means of filling said inflatable tube with a gas, the predetermined applied pressure being for restricting the blood flow into the limb distal to said predetermined range; and measuring means for measuring a physical quantity that varies in conjunction with a pulse wave in said limb on which said tight fitting device is placed, to generate pulse wave data associated with a pulse wave value that represents the amplitude of pulse waves measured at a position near the top of the one of the limbs where the tight fitting device is wrapped around;

the training apparatus being adapted to control said applied pressure;

the training apparatus comprising:

pressure regulating means that is capable of forcing a gas into said inflatable tube and removing the gas from said inflatable tube, via a predetermined tube;

control means for controlling said pressure regulating means in order to change said applied pressure; and notification means adapted to provide, when activated, a notification that can be perceived through human's five senses;

said control means being adapted to receive said pulse wave data from said measuring means, and adapted to activate said notification means, when the pulse wave value of the user falls below a reference pulse wave value.

13. A control method that is carried out by control means of a training apparatus, the training apparatus being used in combination with:

a tight fitting device comprising a band having the length that is enough to be wrapped around a predetermined range of one of the limbs of a user who receives training; an inflatable tube provided in or on said band, said inflatable tube being of air-tight construction; and fastening means for fastening said band on said predetermined range with said band being wrapped around said predetermined range of one of the limbs, said fastening means being provided on said band, said tight fitting device being adapted to apply a predetermined applied pressure to said predetermined range of said limb by means of filling said inflatable tube with a gas, the predetermined applied pressure being for restricting the blood flow into the limb distal to said predetermined range; and a measuring segment for measuring a physical quantity that varies in conjunction with a pulse wave in said limb on which said tight fitting device is placed, to generate pulse wave data associated with a pulse wave value that represents the amplitude of pulse waves;

the training apparatus comprising pressure regulating means that is capable of forcing a gas into said inflatable tube and removing the gas from said inflatable tube, via a predetermined tube; said control means for controlling said pressure regulating means in order to change said applied pressure; and notification means adapted to provide, when activated, a notification that can be perceived through human's five senses;

said control means comprising the steps of:

receiving said pulse wave data from said measuring segment, wherein said pulse wave is detected at a position near the top of the one of the limbs where the tight fitting device is wrapped around; and activating said notification means, when the pulse wave value of the user falls below a reference pulse wave value.

14. A training system comprising:

a tight fitting device comprising a band having the length that is enough to be wrapped around a predetermined range of one of the limbs of a user who receives training; an inflatable tube provided in or on said band, said inflatable tube being of air-tight construction; and fastening means for fastening said band on said predetermined range with said band being wrapped around said predetermined range of one of the limbs, said fastening means being provided on said band, said tight fitting device being adapted to apply a predetermined applied pressure to said predetermined range of said limb by means of filling said inflatable tube with a gas, the predetermined applied pressure being for restricting the blood flow into the limb distal to said predetermined range;

pressure regulating means that is capable of forcing a gas into said inflatable tube and removing the gas from said inflatable tube, via a predetermined tube;

control means for controlling said pressure regulating means in order to change said applied pressure;

measuring means for measuring a physical quantity that varies in conjunction with a pulse wave in said limb on which said tight fitting device is placed, to generate pulse wave data associated with a pulse wave value that represents the amplitude of pulse waves measured at a position near the top of the one of the limbs where the tight fitting device is wrapped around; and notification means adapted to provide, when activated, a notification that can be perceived through human's five senses;

said control means being adapted to receive said pulse wave data from said measuring means, and adapted to activate said notification means, when the pulse wave value of the user falls below a reference pulse wave value.

* * * * *